US008877030B2

(12) United States Patent
Endo et al.

(10) Patent No.: US 8,877,030 B2
(45) Date of Patent: Nov. 4, 2014

(54) PLATING APPARATUS AND PLATING METHOD FOR FORMING MAGNETIC FILM

(75) Inventors: Yasuhiko Endo, Tokyo (JP); Fumio Kuriyama, Tokyo (JP); Masaaki Kimura, Tokyo (JP)

(73) Assignee: Ebara Corporation, Tokyo (JP)

( * ) Notice: Subject to any disclaimer, the term of this patent is extended or adjusted under 35 U.S.C. 154(b) by 886 days.

(21) Appl. No.: 12/458,260

(22) Filed: Jul. 7, 2009

(65) Prior Publication Data

US 2010/0006444 A1 Jan. 14, 2010

(30) Foreign Application Priority Data

Jul. 10, 2008 (JP) ..... 2008-180254

(51) Int. Cl.
*C25D 5/00* (2006.01)
*C25D 17/00* (2006.01)
*C25D 17/12* (2006.01)

(52) U.S. Cl.
CPC ..... *C25D 17/00* (2013.01); *C25D 17/001* (2013.01); *C25D 5/006* (2013.01); *C25D 17/12* (2013.01)
USPC ..... 205/89; 205/90

(58) Field of Classification Search
CPC ..... C25D 5/006; C25D 517/00–517/28; C25D 7/001
USPC ..... 204/660–674; 205/89–91, 117
See application file for complete search history.

(56) References Cited

U.S. PATENT DOCUMENTS 3,141,837 A * 7/1964 Edelman ..... 205/82
3,317,410 A 5/1967 Croll et al.
3,386,895 A * 6/1968 Hunter ..... 205/89
3,480,522 A * 11/1969 Brownlow ..... 205/104
3,652,442 A * 3/1972 Powers et al. ..... 204/273
4,102,756 A 7/1978 Castellani et al.
4,469,564 A * 9/1984 Okinaka et al. ..... 205/125
4,623,439 A 11/1986 Mitsuoka et al.
5,431,769 A * 7/1995 Kisakibaru et al. ..... 156/345.46
6,274,022 B1 * 8/2001 Asai et al. ..... 205/89
6,884,334 B2 * 4/2005 Volodarsky et al. ..... 205/87
2005/0082163 A1 * 4/2005 Yoshioka et al. ..... 204/198
2005/0092600 A1 * 5/2005 Yoshioka et al. ..... 204/198
2005/0241946 A1 * 11/2005 Nagai et al. ..... 205/93
2006/0113185 A1 * 6/2006 Kuriyama et al. ..... 204/275.1
2008/0017505 A1 * 1/2008 Kuriyama et al. ..... 204/286.1
2008/0197021 A1 * 8/2008 Liu et al. ..... 205/90

FOREIGN PATENT DOCUMENTS

JP 4-43990 7/1992
JP 5-1608 1/1993
JP 5-17898 1/1993
JP 7-41996 2/1995
JP 9-310200 12/1997
JP 2002-146593 5/2002
JP 2002-241990 8/2002
JP 2002241990 A * 8/2002
JP 2006-312785 11/2006

* cited by examiner

*Primary Examiner* — James Lin
*Assistant Examiner* — Brian W Cohen
(74) *Attorney, Agent, or Firm* — Wenderoth, Lind & Ponack, L.L.P.

(57) ABSTRACT

A magnetic film plating apparatus employs a dip method that allows relatively good escape of bubbles and does not require a wide footprint and, even when a ferromagnetic material is used for an anode, can form a magnetic film on a substrate surface while minimizing the influence of the anode on the uniformity of magnetic anisotropy in the magnetic film. The magnetic film plating apparatus includes a plating tank for holding a plating solution, an anode vertically disposed in the plating tank at a position to be immersed in the plating solution, a substrate holder for holding a substrate W and positioning the substrate W opposite the anode, and a magnetic field generator, disposed outside the plating tank, for generating a magnetic field around the substrate W held by the substrate holder and positioned opposite the anode.

20 Claims, 23 Drawing Sheets

PLATING APPARATUS AND PLATING METHOD FOR FORMING MAGNETIC FILM

BACKGROUND OF THE INVENTION

1. Field of the Invention

The present invention relates to a magnetic film plating apparatus and method, and more particularly to a magnetic film plating apparatus and method which is useful for forming a magnetic film on an exposed surface of a metal layer formed on a surface of a substrate, such as a semiconductor wafer.

2. Description of the Related Art

As a technique for forming a magnetic film on a device, such as an MRAM or a magnetic head, by electroplating, a method is known, for example, which comprises immersing a substrate, which is held in a horizontal position with a surface to be plated (front surface) of the substrate facing downwardly, in a plating solution in a plating tank, and passing a plating current between the substrate and an anode disposed parallel to the substrate while forming a horizontal magnetic field around the substrate by means of electromagnets (or permanent magnets) disposed on opposite sides of the plating tank (see Japanese Patent laid-Open Publication No. H5-17898). Further, it has been proposed to use, besides a main magnet, an auxiliary magnet for correcting a main magnetic field formed by the main magnet so as to provide a magnetic field parallel to a substrate (see Japanese Patent laid-Open Publication No. S61-190091).

The applicant has proposed a plating apparatus for carrying out a sequence of process steps for plating, such as copper plating, on a surface of a substrate such as a semiconductor wafer, comprising a substrate holder for holding a substrate; a substrate attachment/detachment section for attaching and detaching the substrate to and from the substrate holder; a plating tank for carrying out plating; and a substrate holder transport apparatus for transporting the substrate holder (see Japanese Patent No. 3979847). In this plating apparatus, a substrate in a vertical position is immersed in a plating solution in the plating tank. Therefore, this plating apparatus has the advantages of relatively good escape of bubbles during plating, narrow footprint of the apparatus and good suitability for automation of the apparatus.

SUMMARY OF THE INVENTION

In the case where a magnetic film is formed by electroplating on a surface (surface to be plated) of a substrate which is held horizontally with the surface facing downwardly and immersed in a plating solution in a plating tank, however, escape of bubbles is generally poor. In addition, such a plating apparatus needs a wide footprint and automation of the apparatus is generally difficult.

In the formation of a magnetic film by electroplating, a ferromagnetic material is sometimes used for an anode. When using a ferromagnetic material for an anode and forming a magnetic film on a surface (surface to be plated) of a substrate by electroplating while forming a magnetic field around the substrate, due to the presence of the anode of ferromagnetic material, magnetic field lines will deviate from a reference direction by a certain angle, making it difficult to equalize the magnetic density in the substrate surface. Such non-uniformity of the magnetic density in the substrate surface affects uniformity of the magnetic anisotropy in the magnetic film formed on the substrate. The use of the auxiliary magnet described in the above-cited patent document is not in consideration of the influence of an anode; and therefore it is considered that when a ferromagnetic material is used for an anode, the presence of the anode (ferromagnetic material) will affect the uniformity of magnetic anisotropy in a magnetic film formed on a substrate.

The present invention has been made in view of the above situation. It is therefore an object of the present invention to provide a magnetic film plating apparatus and method which employs a dip method that allows relatively good escape of bubbles and does not require a wide footprint and which, even when a ferromagnetic material is used for an anode, can form a magnetic film on a substrate surface while minimizing the influence of the anode on the uniformity of magnetic anisotropy in the magnetic film.

In order to achieve the above object, the present invention provides a magnetic film plating apparatus comprising: a plating tank for holding therein a plating solution; an anode vertically disposed in the plating tank at a position to be immersed in the plating solution; a substrate holder for holding a substrate and positioning the substrate opposite the anode; and a magnetic field generator, disposed outside the plating tank, for generating a magnetic field around the substrate held by the substrate holder and positioned opposite the anode.

The plating apparatus employs a dip method that allows relatively good escape of bubbles and does not require a wide footprint, and can form a magnetic film on a substrate surface.

The magnetic field generator is comprised, for example, of an electromagnet disposed around the plating tank.

The magnetic field generator may be comprised of a permanent magnet disposed around the plating tank.

Preferably, a first dummy anode, having a larger size than the substrate and surrounding the circumference of the anode, is disposed on the circumference of the anode.

When a ferromagnetic material, such as nickel, is used for the anode, the first dummy anode can reduce deviation of the magnetic flux in a substrate surface from a reference direction.

The first dummy anode preferably has a rectangular shape.

The first dummy anode is at a right angle to the reference direction of the magnetic flux. Accordingly, the use of the first dummy anode of a rectangular shape can make magnetic field lines in the vicinity of a substrate closer to the reference direction.

Preferably, a second dummy anode is disposed on the opposite side of the substrate from the anode, held by the substrate holder and positioned opposite the anode.

The use of the second dummy anode can reduce inclination of magnetic field lines from the vertical direction toward the normal direction of the substrate.

The second dummy anode preferably has the same shape and size as the sum of the anode and the first dummy anode.

Preferably, the surface of the substrate held by the substrate holder, the anode, the first dummy anode and the second dummy anode are disposed parallel to each other in the plating tank.

Preferably, the substrate held by the substrate holder is disposed at the center of a space in which the magnetic field is formed by the magnetic field generator.

Preferably, a stirring paddle for stirring the plating solution in the plating tank is disposed in the plating tank.

The use of the stirring paddle can make the flow of the plating solution along the surface of the substrate more uniform over an entire substrate surface, making it possible to form a magnetic film (plated film) with a more uniform thickness over the entire substrate surface.

Preferably, an electric field regulation plate for regulating the electric field in the plating tank is disposed in the plating tank.

Preferably, a tray for preventing the plating solution from dropping downward is retractably provided under the substrate holder.

The use of the tray can prevent the plating solution, dropping off the substrate holder, from falling onto an electromagnet and the outside of the plating tank when withdrawing the substrate holder from the plating tank after plating and transporting the substrate holder.

The plating tank is preferably provided with an air bag for fixing the substrate holder in a predetermined position.

The use of the air bag enables the substrate holder to be fixed in a predetermined position without using a magnet which may distribute the magnetic field in the plating tank.

Preferably, exhaust ducts are provided at positions along the side of the magnetic field generator.

By creating flows of air flowing from the plating tank toward the exhaust ducts, and discharging a vapor evaporating from the plating solution with the flows of air, contamination of a substrate with the vapor can be prevented. An arbitrary number of exhaust ducts may be provided.

Preferably, the substrate holder is provided with a notch pin which, when the substrate is held by the substrate holder, enters a notch portion of the substrate to align the direction of the substrate with respect to the substrate holder.

When the substrate is held by the substrate holder after aligning the direction of the notch portion of the substrate with respect to the substrate holder, e.g., by an aligner, the direction of the notch portion of the substrate with respect to the substrate holder can always be made precisely constant.

The present invention also provides a magnetic film plating method comprising: vertically disposing an anode and a substrate opposite each other in a plating solution; and applying a plating voltage between the anode and the substrate while forming a magnetic field around the substrate, thereby forming a magnetic film on a surface of the substrate.

The present invention also provides a plating facility comprising: the magnetic film plating apparatus; an aligner for aligning the direction of a substrate; and a main frame in which the magnetic film plating apparatus and the aligner are housed.

The plating tank of the magnetic film plating apparatus is preferably provided in a plural number in the main frame.

Preferably, one or more of a pre-wetting tank, a pre-soaking tank, a blow tank and a rinsing tank are housed in the main frame.

This enables a series of plating process steps to be carried out successively in the same facility.

Preferably, the plating facility further comprises a substrate holder transport apparatus for transporting the substrate holder of the magnetic film plating apparatus, and the substrate held by the substrate holder is transported between the tanks.

Two substrate holders may be placed laterally slidably and parallel to each other on a substrate attachment/detachment section. This enables the use of a single opening/closing mechanism for opening and closing the two substrate holders and, in addition, can eliminate the need to laterally move the substrate transport apparatus.

According to the present invention, a dip method, which does not require a wide footprint, can be employed and, even when a ferromagnetic material is used for an anode, a magnetic film having magnetic anisotropy can be formed on a substrate surface while minimizing the influence of the anode on the uniformity of the magnetic anisotropy.

DETAILED DESCRIPTION OF THE PREFERRED EMBODIMENTS

Preferred embodiments of the present invention will now be described with reference to the drawings. In the following embodiments, a magnetic film of permalloy (Ni/Fe=80/20%) is formed on a surface (surface to be plated) of a substrate, such as a semiconductor wafer. A plating solution capable of forming permalloy is used. An anode of nickel (Ni), which is a ferromagnetic material, or an insoluble anode (e.g., Ti coated with $IrO_2$ or Ti cladded with 1-μm Pt) may be used.

Besides a permalloy magnetic film, a magnetic film of cobalt or a cobalt alloy, for example, can also be formed.

Figure 1:
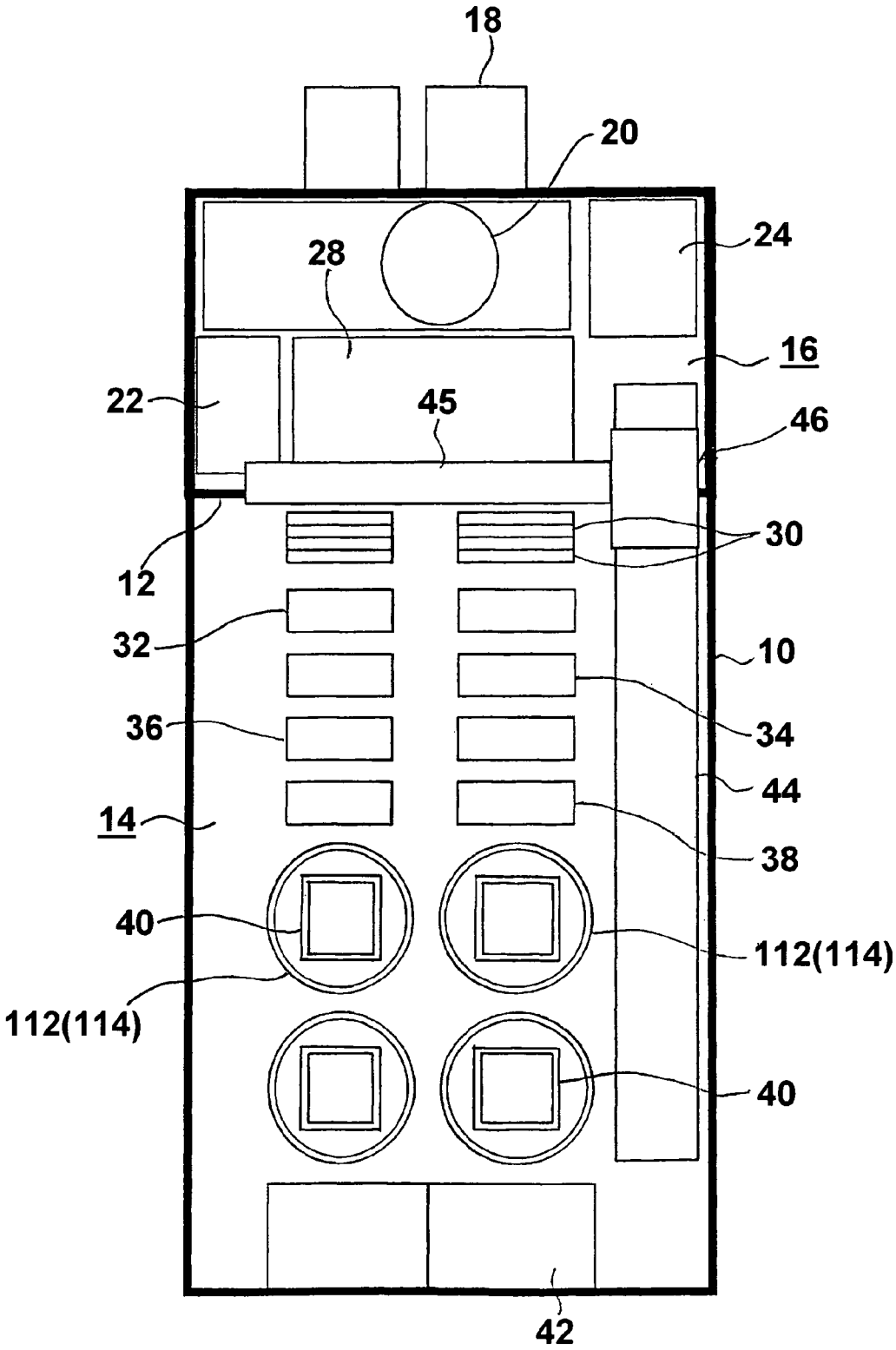
FIG. 1 is an overall plan view of a plating facility according to an embodiment of the present invention.

FIG. 1 shows an overall layout plan of a plating facility according to an embodiment of the present invention. This plating facility performs the whole plating process for a substrate, including pre-plating treatment, plating and post-plating treatment, automatically in a successive manner. The plating facility includes a main frame 10 with a face panel attached thereto. The interior of the main frame 10 is separated by a partition plate 12 into a plating space 14 where plating of a substrate and treatment of the substrate to which a plating solution adheres are carried out, and a cleaning or clean space 16 where the other treatments, not directly associated with a plating solution, are carried out. To the cleaning space 16 is connected a loading/unloading port 18 in which is mounted a substrate cassette, such as FOUP (front opening unified pod), in which substrates such as semiconductor wafers are housed. The main frame 10 is provided with an operation panel (not shown).

Figure 4:
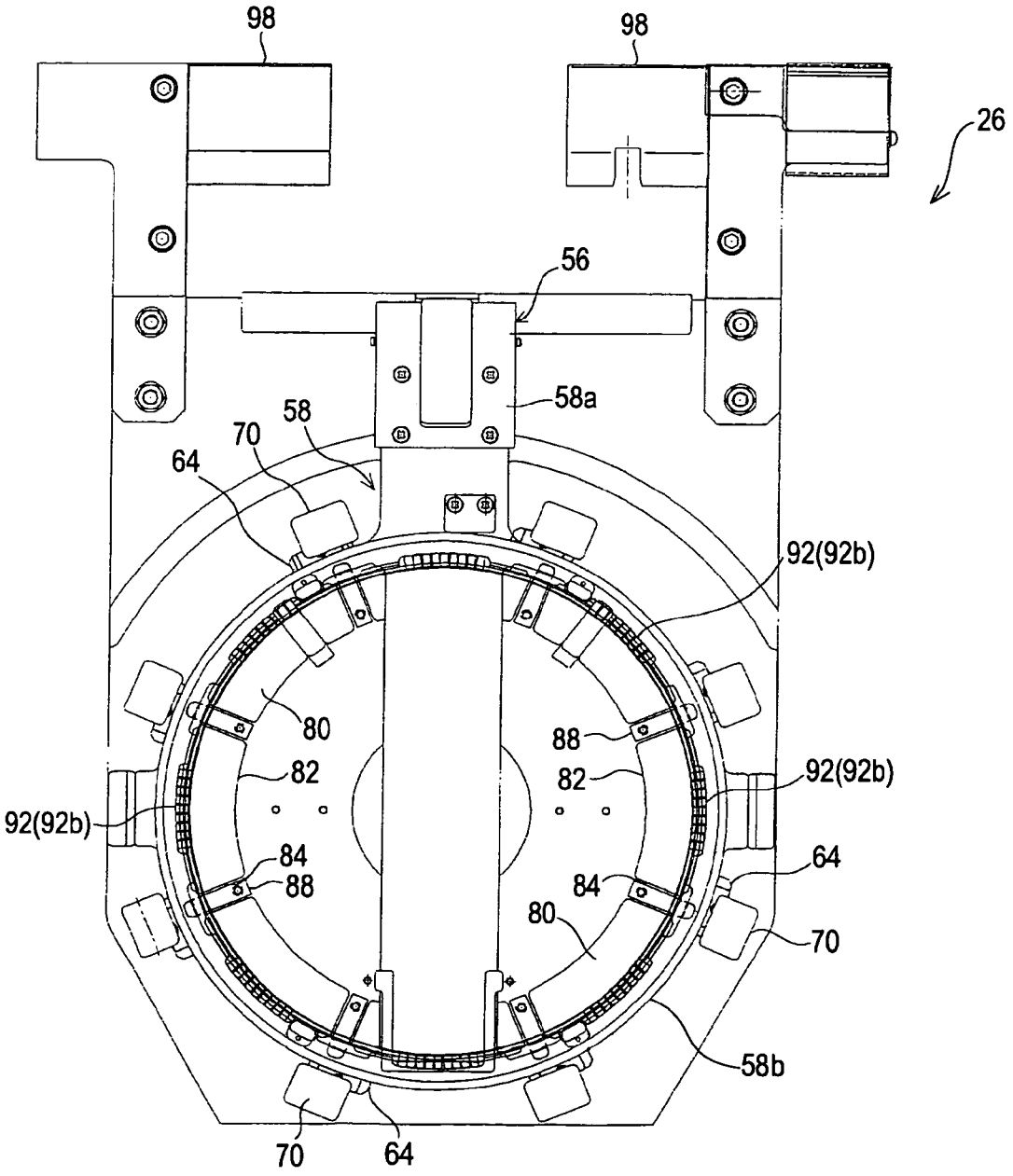
FIG. 4 is a partly-omitted plan view of a substrate holder.
Figure 5:
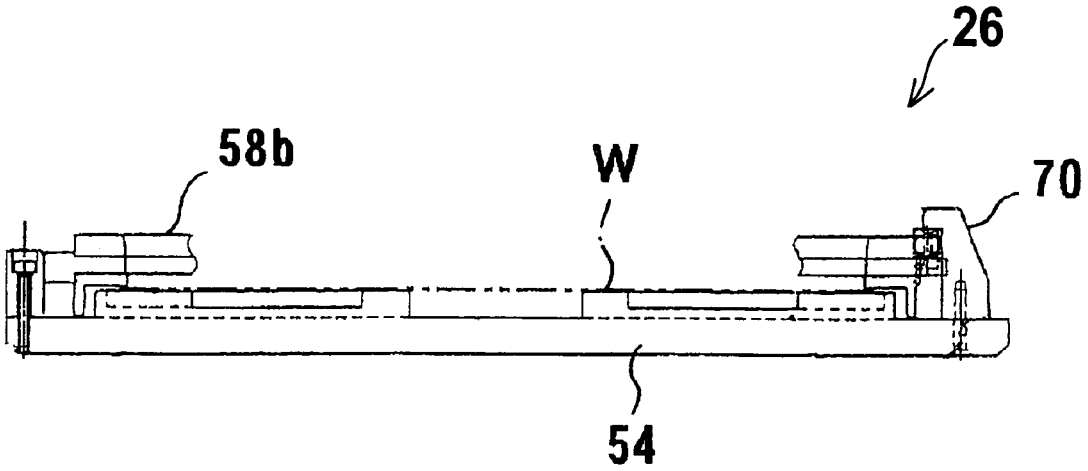
FIG. 5 is a vertical sectional front view of the substrate holder.

In the clean space 16, there are disposed a substrate transport robot 20 for carrying in and carrying out a substrate in a substrate cassette mounted in the loading/unloading port 18, and for transporting a substrate, an aligner 22 for aligning an orientation flat or a notch of a substrate with a predetermined direction, a cleaning/drying device 24 for cleaning (rinsing) a plated substrate with a cleaning liquid, such as pure water, and rotating the substrate at a high speed to dry the substrate, and a substrate attachment/detachment section 28, as a substrate transfer section, for attaching and detaching substrates between it and two substrate holders 26 (see FIGS. 2 and 4), which are disposed parallel to each other.

The substrate transport robot 20 disposed in the clean space 16 is designed so as to hold a substrate and carry in and carry out the substrate in a horizontal state in which a front face (surface to be plated) of the substrate faces upward. The aligner 22 and the cleaning/drying device 24 are designed so as to hold and process a substrate in a horizontal state in which a front face (surface to be plated) of the substrate faces upward.

In the plating space 14, in the order from the partition plate 12, there are disposed four pair (total eight) of stocker tanks 30 for storing or temporarily storing the substrate holders 26, a pair of pre-wetting tanks 32 for enhancing a hydrophilicity of the substrate surface by immersing and wetting with pure water, a pair of pre-soaking tanks 34 for etching away an oxide film, having a large electric resistance, on a seed layer formed on the surface of the substrate with a liquid chemical, such as sulfuric acid or hydrochloric acid, a pair of blow tanks 36 for dewatering the substrate after rinsing (cleaning), a pair of rinsing tanks 38 for rinsing (cleaning) the plated substrate with pure water, and two pair (total four) of plating tanks 40. In the main frame 10, a pair of service tanks 42 for putting in and taking out the substrate holders 26 and anode holder 222 (see FIG. 8) from the apparatus therethrough are provided between the main frame 10 and the plating tanks 40.

Figure 8:
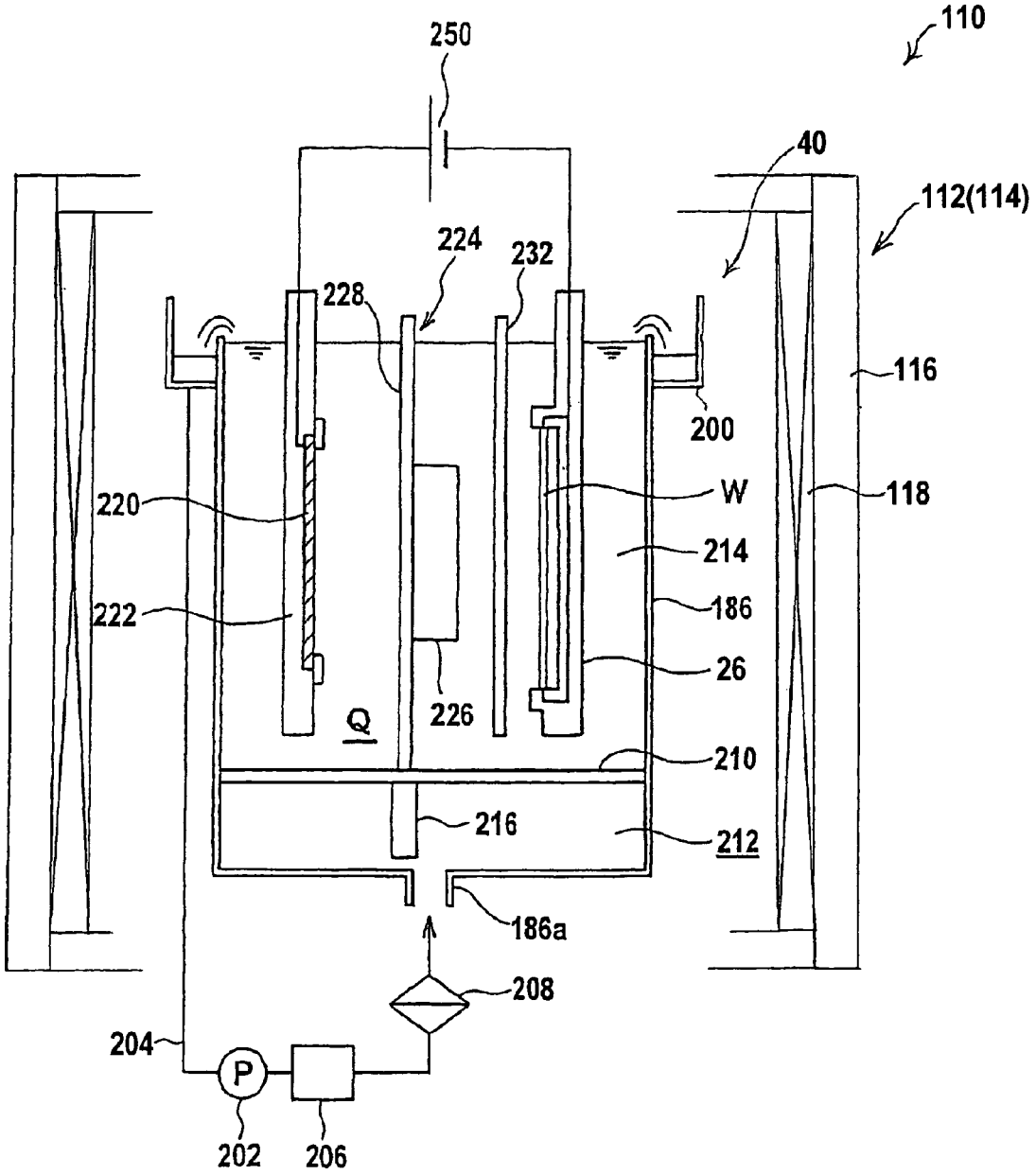
FIG. 8 is a schematic view of a magnetic film plating apparatus according to an embodiment of the present invention.

In this embodiment, as shown in FIG. 8, a substrate holder 26, a plating tank 40 and a magnetic field generator 114, comprised of a cylindrical electromagnet 112 disposed around the plating tank 40, constitute a magnetic film plating apparatus 110.

Figure 2:
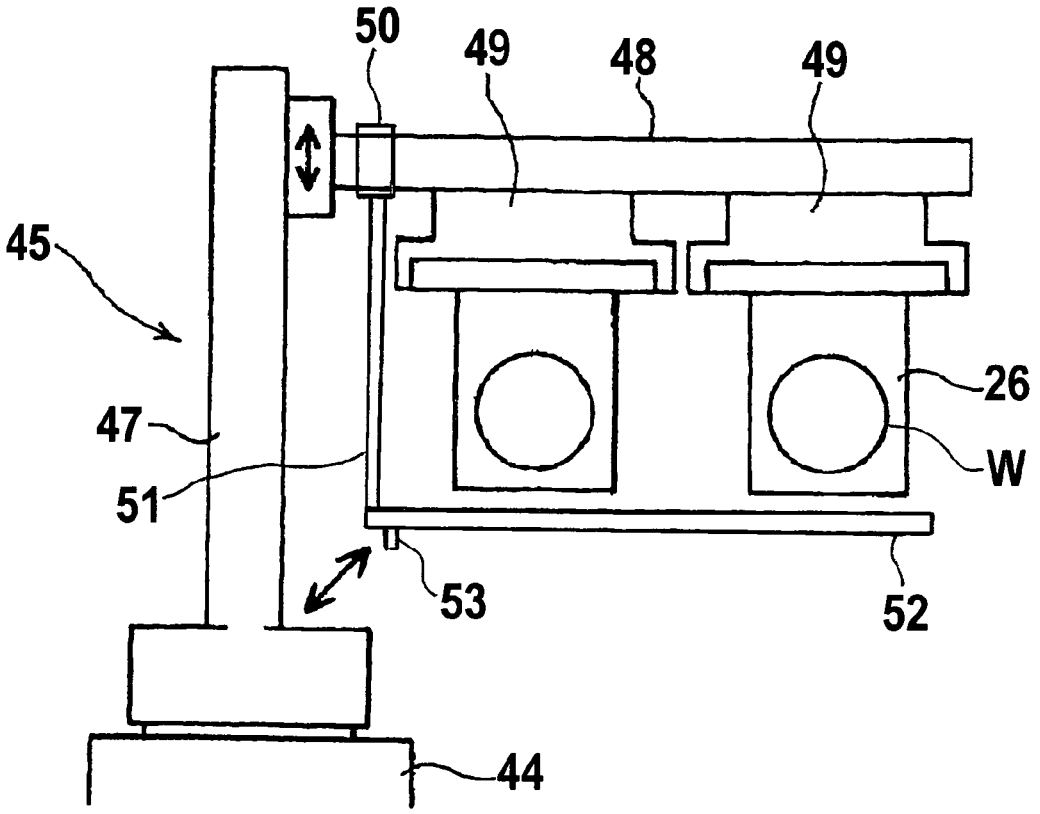
FIG. 2 is a front view showing a substrate holder transport apparatus holding substrate holders.
Figure 3:
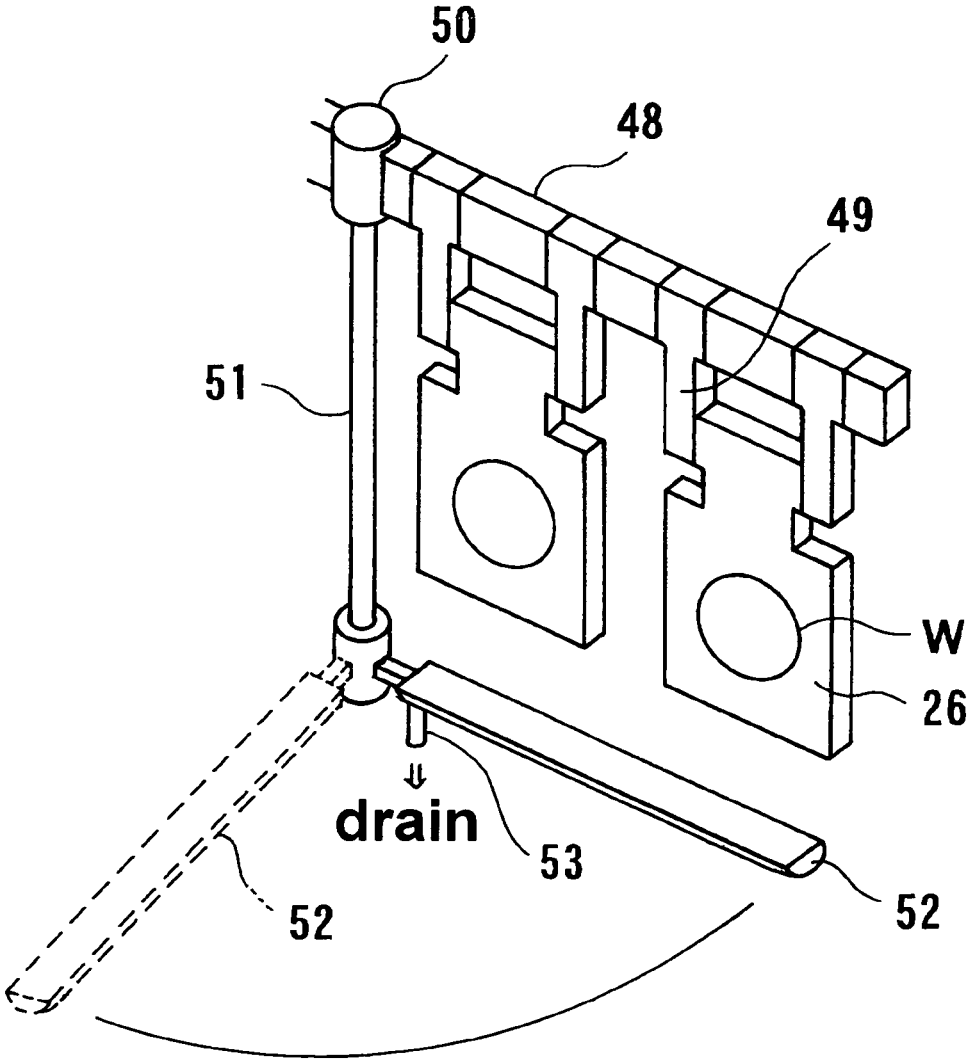
FIG. 3 is a perspective view showing the main portion of the substrate holder transport apparatus holding the substrate holders.

Lateral to the substrate attachment/detachment section 28 and the above tanks is disposed a substrate holder transport apparatus 46 having a transport rail 44 linearly extending along the substrate attachment/detachment section 28 and the tanks, and a transporter 45 which travels on the transport rail 44 while holding two substrate holders 26. As shown in FIGS. 2 and 3, the transporter 45 includes a vertically-extending body 47 which travels on the transport rail 44, and an arm 48 which is vertically movable along the body 47 and rotatable about its axis. In the arm 48 are provided two parallel substrate holding sections 49 each for detachably holding a substrate holder 26.

To the base end of the arm 48 is vertically mounted a rotating shaft 51 which is rotatable by a rotation mechanism 50, and to the lower end of the rotating shaft 51 is coupled a base end of a horizontally-extending tray 52. The tray 52 opens upward, has a semicircular cross-section and, at its rotating shaft 51 side end, is provided with a drain 53 for discharging downward a plating solution collected in the tray 52. With this structure, when withdrawing the substrate holders 26 from the plating tanks 40 and transporting the substrate holders 26, a plating solution dropping from the lower ends of the substrate holders 26 is received by the tray 52 positioned right under the substrate holders 26. This can prevent the plating solution from falling, e.g., onto electromagnet 112 (magnetic field generator 114) or other devices lying outside the plating tanks 40. The tray 52 can be rotated to the retracted position, shown by the broken lines in FIG. 3, by the rotation mechanism 50 so that the tray 52 will not encumber the vertical movements of the substrate holders 26.

As described above, each substrate holder 26, together with each plating tank 40 and a magnetic field generator 114, comprised of a cylindrical electromagnet 112 disposed around the plating tank 40, constitutes a magnetic film plating apparatus 110 (see FIG. 8). Each substrate holder 26 also functions to transport a substrate between the tanks by the substrate holder transport apparatus 46 while holding the substrate.

As shown in FIGS. 4 through 7, the substrate holder 26 has a fixed holding member 54 made of, for example, a vinyl chloride resin in the form of a rectangular flat plate, and a movable holding member 58 mounted openably and closably via a hinge 56 on the fixed holding member 54. While the movable holding member 58 is shown as being openably and closably mounted on the fixed holding member 54 by the hinge 56 in present embodiment, the movable holding member 58 may be disposed in a position facing the fixed holding member 54 and may be moved forward to the fixed holding member 54 so as to be opened and closed with respect thereto.

The movable holding member 58 has a base portion **58*a* and, in this embodiment, a ring-shaped support portion 58*b*, and is made of, for example, a vinyl chloride resin for better slippage against a below-described press ring 62. A ring-shaped sealing member (seal ring) 60 having a substantially channel-shaped transverse cross section with two lips, one being longer than the other, is mounted on a surface of the support portion 58*b*, which faces the fixed holding member 54, of the moveable holding member 58. The ring-shaped sealing member 60 is open toward the fixed holding member 54. A press ring 62 is rotatably supported on a surface of the moveable holding member 58 on the far side from the fixed holding member 54, and slide plates 64 are jointed to outer circumferential surfaces of the press ring 62. The press ring 62** is made of, for example, titanium that is highly resistant to corrosion in oxidizing environments and has sufficient rigidity.

Inverted L-shaped clampers 70, each having an inward protrusion, are vertically mounted on the fixed holding member 54 at circumferentially equal spaced intervals in positions laterally outward of the slide plates 64. The surfaces of the slide plates 64, and the lower surfaces of the inward protrusions of the clampers 70, which are positioned in covering relation to the surfaces of the slide plates 64, are tapered so as to be slanted oppositely to each other in the rotational direction. Projections 73, which comprise rotary pins threaded into the press ring 62, for example, are mounted on the surface of the press ring 62 respectively in a plurality of locations (e.g., four locations) along the circumferential direction of the press ring 62. The projections 73 are engaged by a rotating mechanism for rotating the press ring 62 in unison with the slide plates 64.

When the movable holding member 58 is open, the substrate W is inserted into the center of the fixed holding member 54. After the movable holding member 58 is closed about the hinge 56, the press ring 62 is turned clockwise to cause the slide plates 64 to slide into the protrusions of the clampers 70, thereby fastening and locking the fixed holding member 54 and the movable holding member 58 to each other through their tapered surfaces. By turning the press ring 62 counterclockwise, the slide plates 64 are removed from the protrusions of the L-shaped clampers 70, unlocking the fixed holding member 54 and the movable holding member 58 from each other. When the movable holding member 58 is locked, a shorter lip 60*a* (see FIG. 7) on the inner circumferential surface of the sealing member 60 is in pressure contact with the surface of the substrate W, and a longer lip 60*b* (see FIG. 7) on the outer circumferential surface of the sealing member 60 is in pressure contact with the surface of the fixed holding member 54, respectively. The sealing member 60 is thus uniformly pressed against the substrate W and the fixed holding member 54 to seal the surface of the substrate W and the surface of the fixed holding member 154 reliably.

A ridge 82 is mounted centrally on and projects from the fixed holding member 54 in a ring shape matching the size of the substrate W. The ridge 82 provides a support surface 80 for abutting against the peripheral edge of the substrate W to support the substrate W thereon. The ridge 82 has a plurality of recesses defined therein at predetermined positions along the circumferential direction thereof. A plurality of (eight in the illustrated embodiment) conductors (electrical contacts) 88 are disposed respectively in the recesses 84 and connected to respective wires extending from external contacts on a below-described hand 98. The conductors 88 have their springy ends exposed on the surface of the fixed holding member 54 laterally of the substrate W when the substrate W is placed on the support surface 80 of the fixed holding member 54.

A support body (see FIG. 7) 90 is mounted in an inner space of the sealing member 60 which is defined between the pair of lips 60*a*, 60*b*. Electrical contacts 92 have respective legs 92*a* fixed to the support body 90 at positions confronting the conductors 88. Each electrical contact 92 is formed in a leaf springs shape. Specifically, the electrical contacts 92 have contact ends 92*b* projecting inwardly as leaf springs that can easily flex under their own resiliency.

Figure 6:
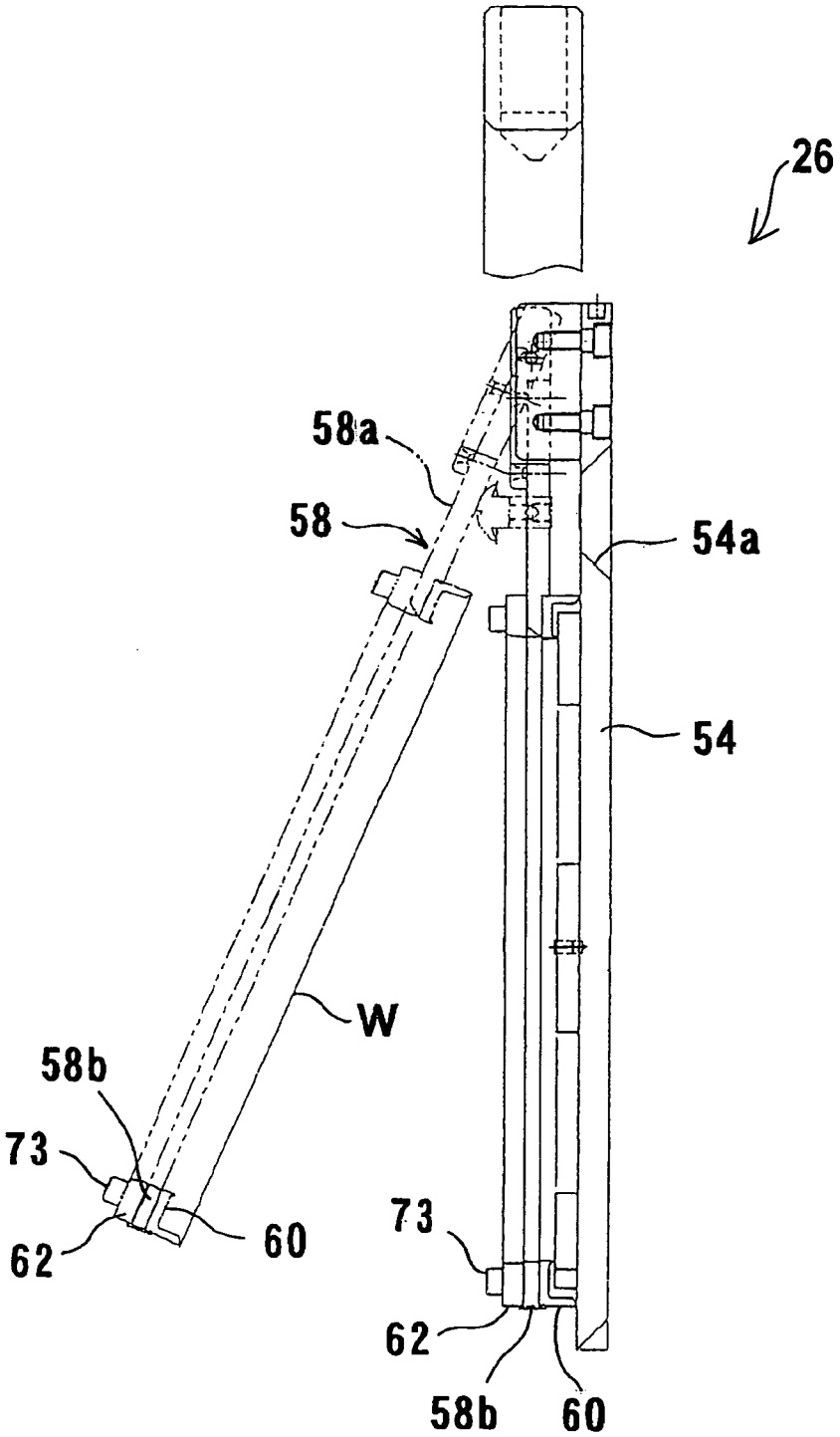
FIG. 6 is a right side view of the substrate holder.

The movable holding member 58 is opened and closed by a cylinder (not shown) and the weight of the movable holding member 58 per se. Specifically, the fixed holding member 54 has a through-hole 54*a*, as shown in FIG. 6, and a cylinder is disposed in a position which confronts the through-hole 54*a* of the substrate holder 26 placed on a loading plate (not shown) of the substrate attachment/detachment section 28. When the piston rod of the cylinder is extended to cause a pusher rod to lift the base portion 58*a* of the movable holding member 58 through the through-hole 54*a*, thereby opening the movable holding member 58. When the piston rod is contracted, the movable holding member 58 is closed under its own weight.

In the present embodiment, the press ring 62 is rotated to lock and unlock the movable holding member 58. A locking/unlocking mechanism for locking and unlocking the movable holding member 58 is mounted on the ceiling side. The locking/unlocking mechanism has gripping members disposed in respective positions aligned with the projections 73 of the press ring 62 of the centrally positioned substrate holder 26 placed on the loading plate of the substrate attachment/detachment section 28. The locking/unlocking mechanism is arranged to rotate the press ring 62 when the gripping members are turned about the axis of the press ring 62 with the loading plate of the substrate attachment/detachment section 28 being lifted and the projections 73 being gripped by the gripping members. There is a single locking/unlocking mechanism being used, and after the locking/unlocking mechanism locks (or unlocks) one of two substrate holders 26 placed on the loading plate of the substrate attachment/detachment section 28, the loading plate of the substrate attachment/detachment section 28 is slid horizontally, and the locking/unlocking mechanism locks (or unlocks) the other substrate holder 26.

A pair of substantially T-shaped hands 98 is jointed to an end of the fixed holding member 54 of the substrate holder 26. The stocker tank 30 is designed so as to engage on an upper surface of a surrounding wall with outwardly projecting portions of the hands 98 of each substrate holder 26 to thus support the substrate holders 26 in such a state that the substrate holders 26 are suspended in a vertical direction. The hands 98 of the substrate holder 26 suspended in a vertical direction are gripped by the transporter 45 of the substrate transport apparatus 46 for transporting the substrate holder 26. The pre-wetting tank 32, the pre-soaking tank 34, the blow tank 36, the rinsing tank 38 and plating tank 40 are also designed so as to support the substrate holders 26 on surrounding walls by the hands 98 in such a state that the substrate holders 26 are suspended in a vertical direction.

Figure 7A:
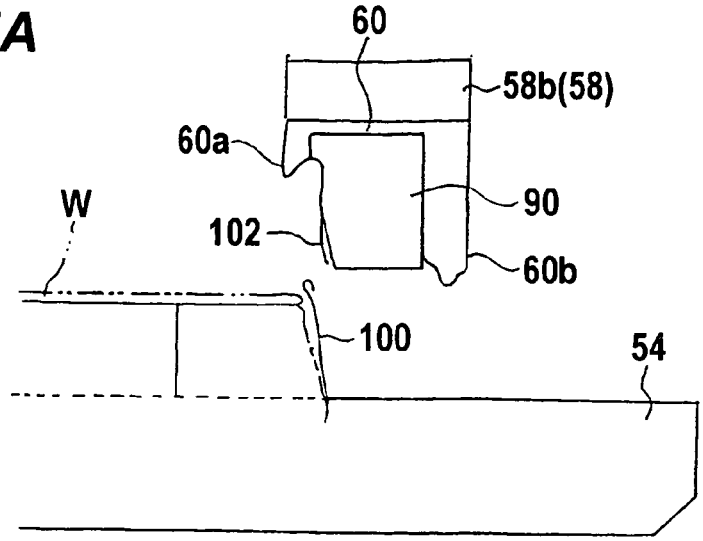
FIGS. 7A through 7C are diagrams illustrating the process of mounting a substrate to the substrate holder while precisely aligning the direction of a notch portion of the substrate.
Figure 7B:
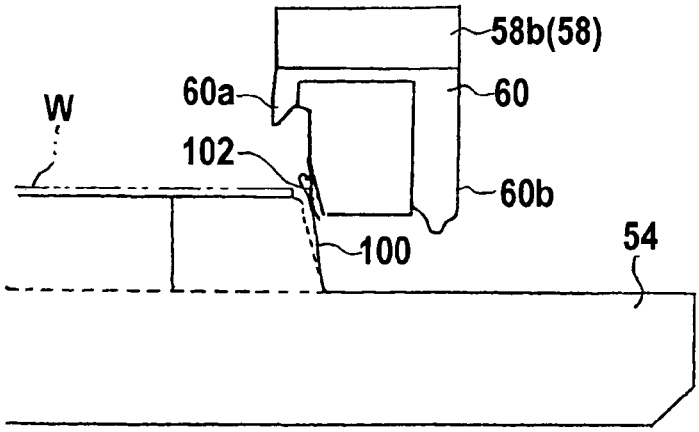
Figure 7C:
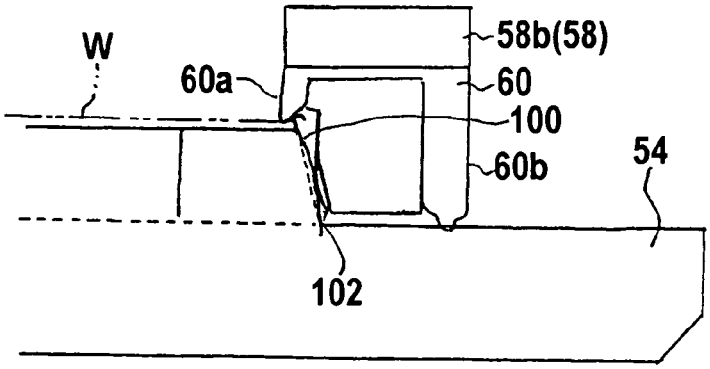

In plating of a magnetic film, it is sometimes necessary to apply a magnetic field precisely in a predetermined direction with respect to a structure formed on a substrate. For this purpose, it is desired to impart to the substrate holder 26 a misalignment prevention function which, after aligning the direction of a notch portion of a substrate W with respect to the substrate holder 26 by the aligner 22, always makes the direction of the notch portion of the substrate W with respect to the substrate holder 26 precisely constant. In this embodiment, as shown in FIGS. 7A through 7C, a rod-like first spring member (notch pin) 100 is mounted to the fixed holding member 54 at a position corresponding to the notch portion of the substrate W, and a plate-like second spring member 102 is mounted to the movable holding member 58 at a position corresponding to the notch portion of the substrate W. When holding the substrate W between the fixed holding member 54 and the movable holding member 58, the second spring member 102 presses the first spring member 100 inwardly, as shown in FIG. 7B, whereby the front end of the first spring member (notch pin) 100 is inserted into the inwardly-curved notch portion of the substrate W, as shown in FIG. 7C. Misalignment of the direction of the notch portion of the substrate W with respect to the substrate holder 26 can thus be prevented.

Though the two spring members, the first spring member 100 and the second spring member 102, are used in this embodiment, it is also possible to integrate the first spring member 100 and the second spring member 102. Though it is preferred that a rod-like spring member (notch pin) be inserted into the notch portion of a substrate W when the substrate W is held by a substrate holder 26, and the rod-like spring member (notch pin) separate from the notch portion of the substrate W when the holding of the substrate W by the substrate holder 26 is released, it is also possible to allow a stationary pin to be inserted into the notch portion of a substrate without using an elastically deformable member. By thus utilizing the operation of holding the substrate W between the fixed holding member 54 and the movable holding member 58, and causing the elastic members, such as a plate spring, to deform, the misalignment prevention mechanism can be constructed with a relatively simple structure.

FIG. 8 schematically shows the magnetic film plating apparatus 110. As shown in FIG. 8, the magnetic film plating apparatus 110 mainly comprises the above-described substrate holder 26, a plating tank 40 and a magnetic field generator 114 comprised of a cylindrical electromagnet 112 disposed around the plating tank 40.

The plating tank 40 includes a plating tank body 186 for holding a certain amount of plating solution Q in which a substrate W, held by the substrate holder 26 with its peripheral portion watertightly sealed by the seal member 60 (see FIGS. 7A through 7C) and its front surface (surface to be plated) exposed, is to be immersed in a vertical position. An overflow tank 200 for receiving the plating solution Q that has overflowed an edge of the plating tank body 186 is provided around an upper portion of the plating tank body 186. One end of circulation piping 204, which is provided with a pump 202, is connected to the bottom of the overflow tank 200, and the other end of the circulation piping 204 is connected to a plating solution supply inlet 186*a* provided at the bottom of the plating tank body 186. Thus, the plating solution Q collected in the overflow tank 200 is returned into the plating tank body 186 by the actuation of the pump 202. Located downstream of the pump 202, a constant-temperature unit 206 for controlling the temperature of the plating solution Q, and a filter 208 for filtering out foreign matter contained in the plating solution are interposed in the circulation piping 204.

A bottom plate 210 having therein a large number of plating solution passage holes is disposed in the bottom of the plating tank body 186, whereby the interior of the plating tank body 186 is separated into an upper substrate processing chamber 214 and a lower plating solution distribution chamber 212. A downwardly-extending shield plate 216 is mounted to the bottom plate 210.

Thus, in the plating tank 40 of this embodiment, the plating solution Q is introduced into the plating solution distribution chamber 212 of the plating tank body 186 by the actuation of the pump 202, passes through the large number of plating solution passage holes of the bottom plate 210 and flows into the substrate processing chamber 214, flows upwardly approximately parallel to the surface of the substrate W held by the substrate holder 26 and flows into the overflow tank 200. The plating tank 40 is thus constructed so that the plating solution Q can be moved approximately parallel to the surface of the substrate W by actuating the pump 202 when carrying out plating.

A disk-shaped anode 220, conforming to the shape of the substrate W, is held by an anode holder 222 and is disposed in the plating tank body 186 in a vertical position. When the plating solution Q is filled into the plating tank body 186, the anode 220 becomes immersed in the plating solution Q and faces the substrate W held by the substrate holder 26 and disposed at a predetermined position in the plating tank body 186. Also in the plating tank body 186, an electric field regulation plate 224 for regulating an electric field in the plating tank body 186 is disposed between the anode 220 and the substrate holder 26 disposed at a predetermined position in the plating tank body 186. In this embodiment, the electric field regulation plate 224 is comprised of a cylindrical portion 226 and a rectangular flange portion 228, and is made of polyvinyl chloride, which is a dielectric material. The cylindrical portion 226 has such an opening size and axial length as to sufficiently regulate the extent of the electric field. The lower end of the flange portion 228 of the electric field regulation plate 224 reaches the bottom plate 210.

In the plating tank body 186, between the electric field regulation plate 224 and the substrate W, held by the substrate holder 26 and disposed at a predetermined position in the plating tank body 186, is disposed a vertically-extending stirring paddle 232 which reciprocates parallel to the substrate W to stir the plating solution Q between the substrate W and the electric field regulation plate 224. By stirring the plating solution Q between the substrate W and the electric field regulation plate 224 by the stirring paddle 232, ions in the plating solution Q can be supplied uniformly to the surface of the substrate W.

Figure 9:
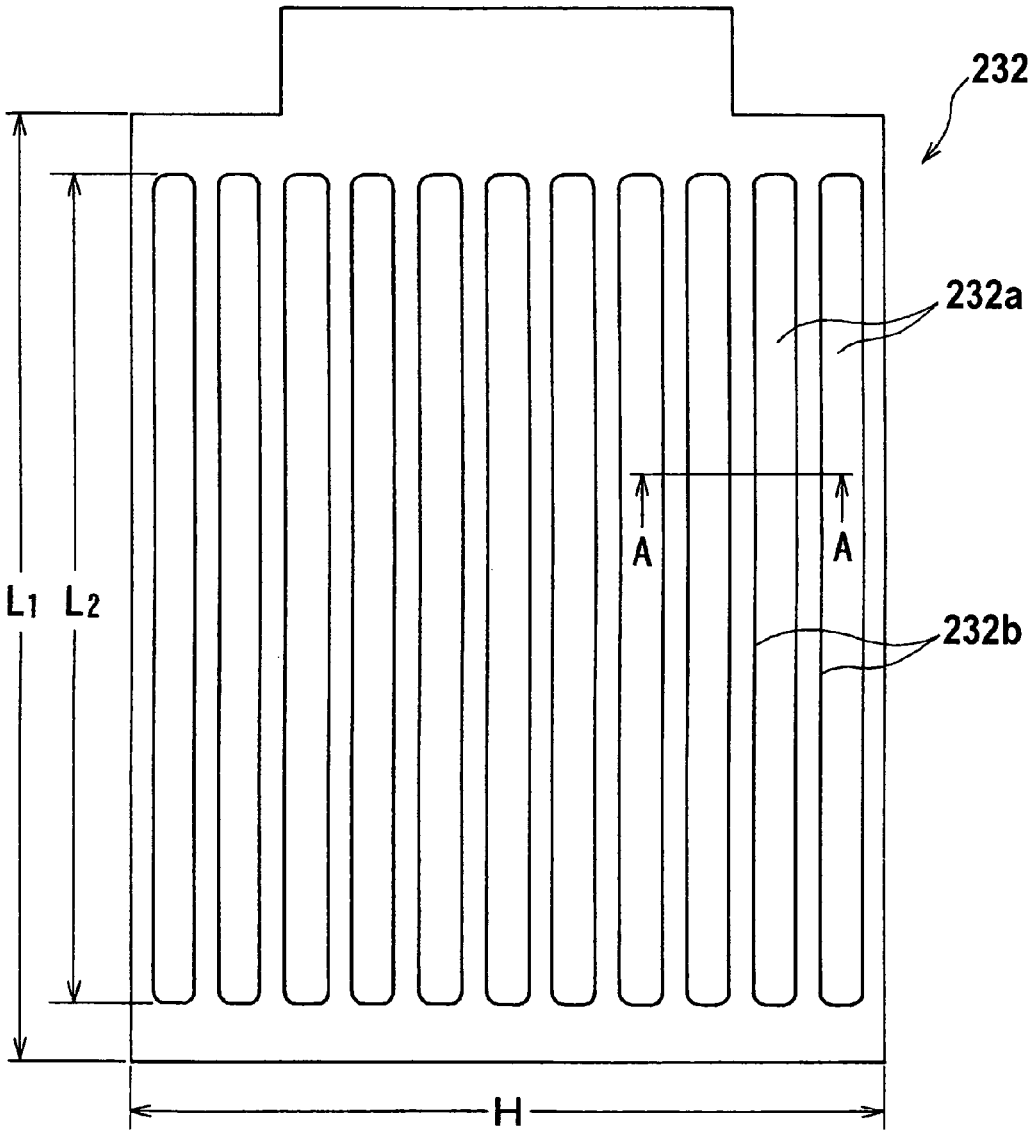
FIG. 9 is a plan view of a stirring paddle.
Figure 10:
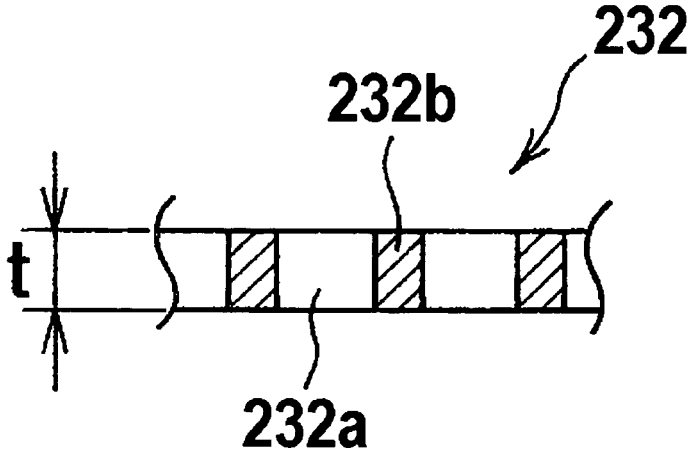
FIG. 10 is a cross-sectional view taken along line A-A of FIG. 9.

As shown in FIGS. 9 and 10, the stirring paddle 232 is comprised of a rectangular plate-like member having a uniform thickness "t" of 3 mm to 5 mm, and has a plurality of parallel slits 232*a* that define vertically-extending strip-like portions 232*b*. The stirring paddle 232 is formed of, for example, titanium with a Teflon coating. The vertical length $L_1$ of the stirring paddle 232 and the vertical length $L_2$ of the slits 232*a* are sufficiently larger than the vertical size of the substrate W. Further, the stirring paddle 232 is so designed that the sum of its lateral length H and its reciprocation distance (stroke) is sufficiently larger than the lateral size of the substrate W.

It is preferred that the width and the number of the slits 232*a* be determined such that each strip-shaped portion 232*b* is as narrow as possible insofar as it has the necessary rigidity so that the strip-shaped portions 232*b* between the slits 232*a* can efficiently stir the plating solution and, in addition, the plating solution can efficiently pass through the slits 232*a*.

Figure 11A:
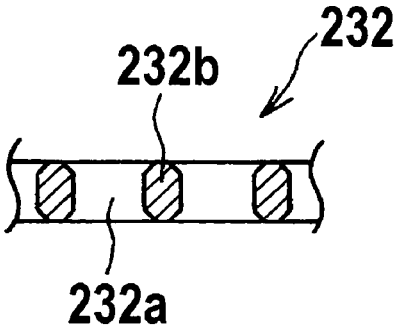
FIGS. 11A and 11B are cross-sectional views equivalent to FIG. 10, showing variations of the stirring paddle.
Figure 11B:
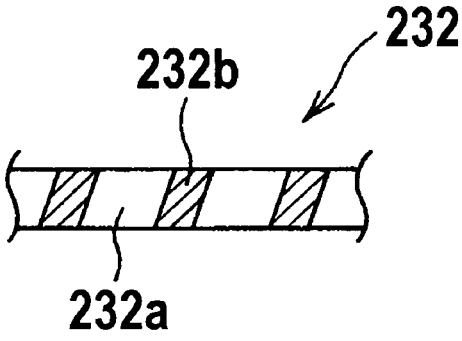

In this embodiment, as shown in FIG. 10, the slits 232*a* are formed vertically such that each strip-shaped portion 232*b* has a rectangular cross section. As shown in FIG. 11A, each strip-shaped portion 232*b* may be chamfered at the four corners in its cross section or, as shown in FIG. 11B, each strip-shaped portion 232*b* may be angled so that it has a parallelogram cross-sectional shape.

Figure 12:
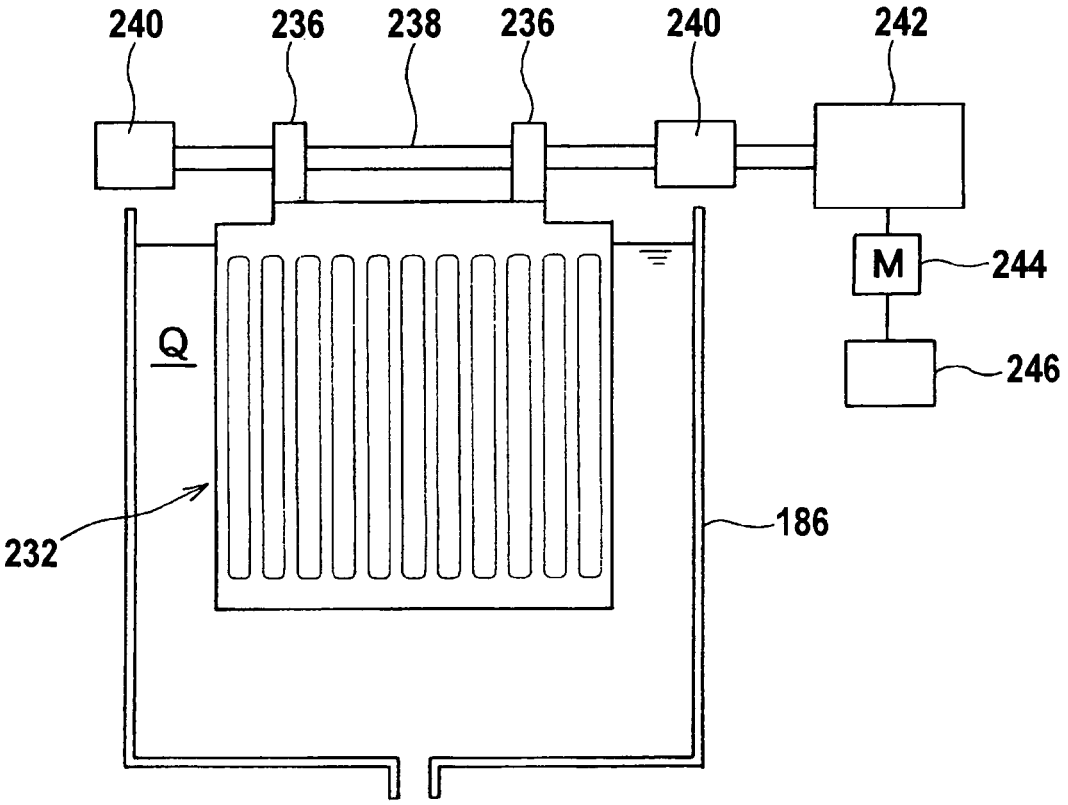
FIG. 12 is a schematic view showing a paddle drive mechanism of the magnetic film plating apparatus shown in FIG. 8 together with a plating tank.

As shown in FIG. 12, the stirring paddle 232 is secured to a horizontally-extending paddle shaft 238 by clamps 236 fixed to the upper end of the stirring paddle 232. The paddle shaft 238 is held by shaft holders 240 and can slide horizontally. An end of the paddle shaft 238 is coupled to a paddle drive section 242 for reciprocating the stirring paddle 232 linearly and horizontally. The paddle drive section 242 converts the rotation of a motor 244 into the linear reciprocating movement of the paddle shaft 238 by a crank mechanism (not shown). In this embodiment, a control section 246, which controls the movement velocity of the stirring paddle 232 by controlling the rotational speed of the motor 244 of the paddle drive section 242, is provided. Instead of the paddle drive section 242 which uses the crank mechanism, it is also possible to use a paddle drive section which converts the rotation of a servo motor into the linear reciprocating movement of a paddle shaft by a ball screw, or a paddle drive section which linearly reciprocates a paddle shaft by a linear motor. A movement velocity of the stirring paddle 232, for obtaining a sufficient stirring effect by the stirring paddle 232, is preferably not less than 0.2 m/sec, more preferably not less than 0.5 m/sec. From the viewpoint of an apparatus design, the movement velocity of the stirring paddle 232 is not more than 2.0 m/sec.

The magnetic film plating apparatus 110 is provided with a plating power source 250; the anode is connected to the anode 220 via a conducting wire, and the cathode is connected to the substrate W via a conducting wire during plating.

In this embodiment, as shown in FIG. 8, a magnetic field generator 114 comprised of a cylindrical electromagnet 112 is disposed around the plating tank 40 including the plating tank body 186 and the overflow tank 200. The electromagnet 112 is comprised of a cylindrical yoke 116 and a coil 118 extending circumferentially on an inner circumferential surface of the yoke 116. Bypassing electric current through the coil 118, the electromagnet 112 forms an upwardly directed magnetic field around and approximately parallel to a substrate held by the substrate holder 26. The electromagnet 112 is coated with a resin resistant to a plating solution so that the electromagnet 112 will not be damaged by contact with the plating solution.

Figure 13A:
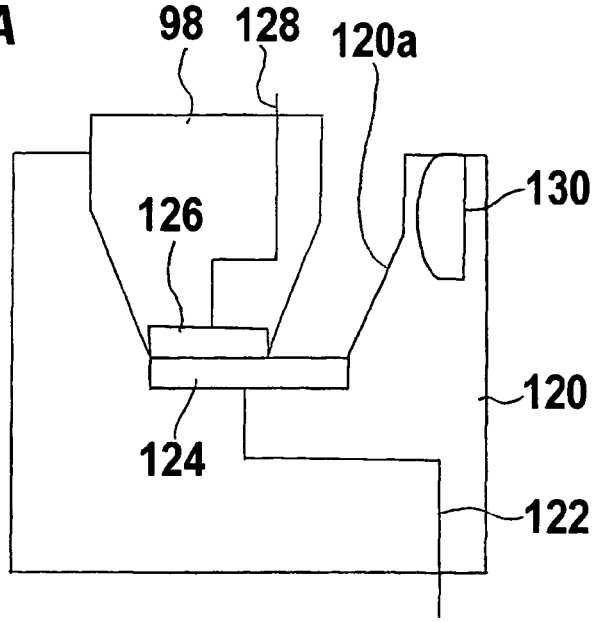
FIG. 13A is a cross-sectional diagram illustrating the relationship between a substrate holder receiver, provided in an upper surface of a surrounding wall of the plating tank, and a hand of the substrate holder before fixing of the hand.
Figure 13B:
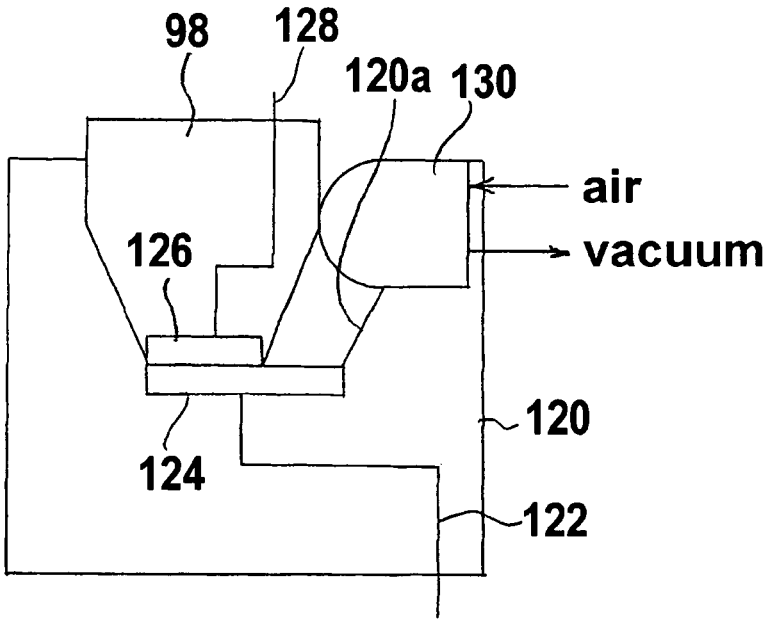
FIG. 13B is a cross-sectional diagram illustrating the relationship between the substrate holder receiver, provided in the upper surface of the surrounding wall of the plating tank, and the hand of the substrate holder after fixing of the hand.

As shown in FIGS. 13A and 13B, a substrate holder receiver 120, having an upwardly-open positioning recess 120*a*, is mounted at a predetermined position in an upper surface of a surrounding wall of the plating tank 40. By inserting the end of the hand 98 of the substrate holder 26 into the recess 120*a*, the substrate holder 26 is supported and suspended vertically in the plating tank 40 while positioning the substrate holder 26 with respect to the plating tank 40. A receiver contact terminal 124, connected to a wire 122 extending from an external power source, is mounted at the bottom of the recess 120*a*, while a holder contact terminal 126 is mounted to the end of the hand 98 at a position facing the receiver contact terminal 124. The holder contact terminal 126 connects with the above-described conductor 88 via a wire 128. When the hand 98 of the substrate holder 26 is inserted into the recess 120*a*, both contact terminals 124, 126 come into contact with each other to allow passage of electricity.

To facilitate insertion of the hand 98 into the recess 120*a*, the width of the recess 120*a* is somewhat larger than the width of the hand 98. Therefore, in this embodiment, an air bag 130 is provided in one sidewall of the recess 120*a* of the substrate holder receiver 120. After inserting the hand 98 into the recess 120*a*, as shown in FIG. 13A, the air bag 130 is expanded by a gas, such as air, as shown in FIG. 13B, so that the air bag 130 presses the hand 98 against the other sidewall of the recess 120*a*, thereby positioning the substrate holder 26 with respect to the plating tank 40. When taking out the substrate holder 26, the volume of the air bag 130 is reduced by sucking the gas from the air bag 130 by vacuum, or by opening the air bag 130 to the air. The use of the air bag 130 can prevent, without using a magnet which may disturb the magnetic field in the plating tank 40, irregular movements of the substrate holder 26 caused by the pressure of the plating solution flowing by the movement of the stirring paddle 232, thereby preventing poor contact between the contact terminals 124, 126. It is also possible to use, e.g., an air cylinder or a motor instead of the air bag.

In operation of the magnetic film plating apparatus 110, a predetermined amount of plating solution Q having a predetermined composition is first filled into the plating tank body 186 and allowed to circulate. The substrate holder 26 holding a substrate W is lowered to dispose the substrate W at a predetermined position in the plating tank body 186 where the substrate W is immersed in the plating solution Q and held vertically. The anode of the plating power source 250 is connected to the anode 220 and the cathode is connected to the substrate W and, at the same time, electric current is passed through the coil 118 of the electromagnet 112, thereby forming an upwardly directed magnetic field around and approximately parallel to the substrate W held by the substrate holder 26. A plated film, a magnetic film (permalloy) having magnetic anisotropy, is allowed to grow on the surface of the substrate W while stirring the plating solution Q between the electric field regulation plate 224 and the substrate W by the stirring paddle 232, as necessary, by moving the stirring paddle 232 parallel to the substrate W. By actuating the pump 202 of the circulation piping 204, as necessary, during plating, the plating solution Q is circulated while keeping the plating solution Q at a predetermined temperature by cooling or heating it. After a predetermined time has elapsed from the start of plating, the anode 220 and the substrate W are disconnected from the plating power source 250, and the supply of electric current to the coil 118 of the electromagnet 112 and the reciprocation of the stirring paddle 232 are stopped, thereby terminating plating.

A sequence of process steps for plating of a magnetic film by the thus-constructed plating facility of this embodiment will now be described. First, substrates W having a surface seed layer as a feeding layer are placed with their front surfaces (surfaces to be plated) facing upwardly in a substrate cassette, and the substrate cassette is mounted in the loading/unloading port 18. One substrate is taken by the substrate transport robot 20 out of the cassette mounted in the loading/unloading port 18, and the substrate is place on the aligner 22 to align the direction of a notch portion or an orientation flat. After the alignment, the substrate is transported to the substrate attachment/detachment section 28 by the substrate transport robot 20.

In the substrate attachment/detachment section 28, two substrate holders 26 housed in the stocker tanks 30 are simultaneously gripped by the substrate holder holding section 49 of the transporter 45 of the substrate transport apparatus 46 and the arm 48 is raised. The substrate holders 26 are then transported to the substrate attachment/detachment section 28, where the arm 48 is rotated 90 degrees to bring the substrate holders 26 into a horizontal position. Thereafter, the arm 48 is lowered to simultaneously place the two substrate holders 26 on the loading plate of the substrate attachment/detachment section 28, and then the cylinder is actuated to open the movable holding member 58 of the substrate holder 26.

In this state, the substrate, which has been transported by the substrate transport robot 20, is inserted into the substrate holder 26 positioned on the center side, and the cylinder is reversely actuated to close the movable holding member 58, and then the movable holding member 58 is locked by the locking/unlocking mechanism. Misalignment of the direction of the notch portion of the substrate W with respect to the substrate holder 26 upon this operation can be prevented by the first spring member 100 and the second spring member 102, as shown in FIGS. 7A through 7C. After completion of the attachment of the substrate to the one substrate holder 26, the loading plate of the substrate attachment/detachment section 28 is slid laterally, and a substrate is attached to the other substrate holder 26 in the same manner. Thereafter, the loading plate is returned to the original position.

Each substrate is thus fixed in each substrate holder 26 with its front surface (surface to be plated) exposed in the opening of the substrate holder 26 and its periphery sealed with the seal member 60 to prevent intrusion of a plating solution thereinto so as to allow electrical connection within the sealed portion, not in contact with the plating solution, with the plurality of electrical contacts 92. The wire 128 from the conductors (electrical contacts) 88 is connected to the hand 98 of the substrate holder 26. Therefore, electricity can be fed to the seed layer of the substrate by electrically connecting the contact terminals 124, 126.

Next, the two substrate holders 26 with the substrates attached thereto are simultaneously gripped by the substrate holder holding section 49 of the transporter 45 of the substrate transport apparatus 46 and the arm 48 is raised. The substrate holders 26 are then transported to the stocker tanks 30, where the arm 48 is rotated 90 degrees to bring the substrate holders 26 into a vertical position. Thereafter, the arm 48 is lowered to simultaneously suspend the two substrate holders 26 in the stocker tanks 30 for temporary storage of the substrate holders 26. The above operations are repeated sequentially to sequentially attach substrates to substrate holders 26, which have been housed in the stocker tank 30, and sequentially suspend the substrate holders 26 with the substrates attached in predetermined positions in the stocker tank 30 for their temporary storage.

The two substrate holders 26 with the substrates attached thereto, which have been temporarily stored in the stocker tanks 30, are simultaneously gripped by the substrate holder holding section 49 of the transporter 45 of the substrate transport apparatus 46 and the arm 48 is raised. The substrate holders 26 are then transported to the pre-wetting tanks 32, where the arm 48 is lowered to immerse the substrate holders 26, e.g., in pure water held in the pre-wetting tanks 32, thereby wetting the surfaces of the substrates to enhance the hydrophilic properties. It is, of course, possible to use any aqueous liquid other than pure water insofar as the liquid can wet the surface of the substrate and replace air in holes with the liquid, thereby enhancing the hydrophilic properties of the substrate surface.

A substrate holder 26 in which is housed a substrate whose electrical contact condition has been determined to be poor by a sensor, provided in the substrate holder 26, for sensing contact between the substrate and the electrical contacts, is kept temporarily stored in the stocker tank 30. This enables continuing plating operations without a stop of the apparatus despite the poor contact between the electrical contacts and the substrate attached to the substrate holder 26. The substrate of poor electrical contact is not subjected to plating. In this case, after substrates are returned to the substrate cassette, the unplated substrate is removed from the substrate cassette.

Next, in the same manner as described above, the two substrate holders 26 with the substrates attached thereto are transported to the pre-soaking tanks 34, and the substrates are immersed in a liquid chemical, such as sulfuric acid or hydrochloric acid, held in the pre-soaking tanks 34 to etch away an oxide film, having a high electrical resistance, from the surface of the seed layer, thereby exposing a clean metal surface. Thereafter, in the same manner as described above, the substrate holders 26 with the substrates attached thereto are transported to the rinsing tanks 38, and the substrate surfaces are rinsed (cleaned) with pure water held in the rinsing tanks 38.

In the same manner as described above, the two substrate holders 26 with the substrates attached thereto are transported after rinsing to the plating tanks 40 filled with a plating solution, and are each suspended and held at a predetermined position in each plating tank 40. When the substrate is held in the plating tank 40, as shown in FIG. 13A, the end of the hand 98 of the substrate holder 26 is inserted into the recess 120*a* of the substrate holder receiver 120 of the plating tank 40, and the contact terminals 124, 126 come into contact with each other, thereby allowing passage of electric current. Then, as shown in FIG. 13B, the air bag 130 is expanded by a gas, such as air, so that the air bag 130 presses the hand 98 against the sidewall of the recess 120*a*, thereby positioning the substrate holder 26 with respect to the plating tank 40. Then, while supplying the plating solution into the plating tank 40 and allowing the plating solution to overflow into the overflow tank 200, a plating voltage is applied between the anode 200 and the substrate and, at the same time, electric current is passed through the coil 118 of the electromagnet 112, thereby forming an upwardly directed magnetic field around and approximately parallel to the substrate held by the substrate holder 26. A magnetic film of permalloy, having magnetic anisotropy, is allowed to grow on the surface of the substrate while stirring the plating solution, as necessary, by moving the stirring paddle 232 parallel to the surface of the substrate by the paddle drive section 242.

After the completion of plating, the application of the plating voltage, the supply of the plating solution, the supply of electric current to the coil 118 of the electromagnet 112 and the reciprocation of the stirring paddle 232 are stopped. Thereafter, the two substrate holders 26 with the substrates after plating attached thereto are simultaneously gripped by the substrate holder holding section 49 of the transporter 45 of the substrate transport apparatus 46, and the arm 48 is raised to withdraw the substrates from the plating solution Q in the plating tanks 40. When thus withdrawing the substrate holders 26 from the plating solution Q in the plating tanks 40, the tray 52 shown in FIGS. 2 and 3 is moved from the retracted position to the position right under the substrate holders 26, and then, in the same manner as described above, the substrate holders 26 are transported to the rinsing tanks 38. Thus, the plating solution dropping from the substrate holders 26 is received by the tray 52, thereby preventing the plating solution from falling, e.g., onto the magnetic field generator 114 using the electromagnet 112 or other devices lying outside the plating tanks 40.

After returning the tray 52 to the retracted position, the substrate holders 26 are lowered to immerse the substrates in pure water held in the rinsing tanks 38, thereby rinsing (cleaning) the surfaces of the substrates with pure water. Thereafter, the substrate holders 26 with the substrates attached thereto are transported to the blow tanks 36 in the same manner as described above, where water droplets are removed from the substrate holders 26 by air blowing. Thereafter, the substrate holders 26 with the substrates attached thereto are returned to the stocker tanks 30 and are each suspended and held at a predetermined position in the stocker tank 30 in the same manner as described above.

The two substrate holders 26 with the substrates attached thereto, which have been returned to the stocker tanks 30 after plating, are simultaneously gripped by transporter 45 of the substrate transport apparatus 46 and, in the same manner as described above, are placed on the loading plate of the substrate attachment/detachment section 28. The substrate holder 26 in which is housed the substrate whose electrical contact condition has been determined to be poor by the sensor, provided in the substrate holder 26, for sensing contact between the substrate and the electrical contacts, and which has been kept temporarily stored in the stocker tank 30, is also transported and placed on the loading plate.

The movable holding member 58 of the substrate holder 26 positioned on the center side is unlocked by the locking/unlocking mechanism, and the cylinder is actuated to open the movable holding member 58. The substrate after plating is then taken by the substrate transport robot 20 out of the substrate holder 26, and transported to the cleaning/drying device 24, where the substrate is cleaned and then spin-dried by high-speed rotation of the cleaning/drying device 24. The dried substrate is returned by the substrate transport robot 20 to the substrate cassette of the loading/unloading port 18.

After, or in parallel with, returning the substrate, which has been taken out of the one substrate holder 26, to the substrate cassette, the loading plate of the substrate attachment/detachment section 28 is slid laterally and the other substrate is taken out of the other substrate holder 26. The substrate is then treated in the same manner, and the spin-dried substrate is returned to the substrate cassette.

After returning the loading plate of the substrate attachment/detachment section 28 to the original position, the two substrate holders 26, from which the substrates have been taken out, are simultaneously gripped by the substrate holder holding section 49 of the transporter 45 of the substrate transport apparatus 46 and, in the same manner as described above, are returned to the predetermined positions in the stocker tanks 30. Thereafter, two substrate holders 26, which have been returned to the stocker tanks 30, are simultaneously gripped by the substrate holder holding section 49 of the transporter 45 of the substrate transport apparatus 46 and, in the same manner as described above, are placed on the loading plate of the substrate attachment/detachment section 28. Thereafter, the same operations as described above are repeated.

As described hereinabove, according to the plating facility of this embodiment, by setting a substrate cassette, in which substrates are housed, in the loading/unloading port 18 and activating the apparatuses, electroplating using a dip method can be carried out in a fully automatic manner to form a magnetic film (plated film) of, e.g., permalloy, having magnetic anisotropy, on a surface of a substrate.

By arranging a plurality of plating tanks 40, each individually surrounded by the magnetic field generator 114 comprised of the electromagnet 112, as in this embodiment, the formation of a magnetic field parallel to a substrate can be facilitated.

Figure 14:
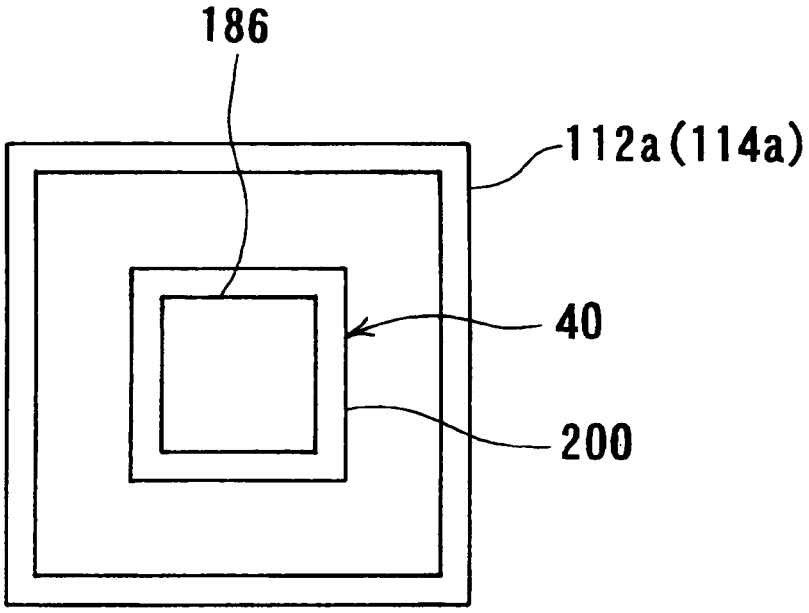
FIG. 14 is a plan view showing another example of a plating tank and magnetic field generator.
Figure 15:
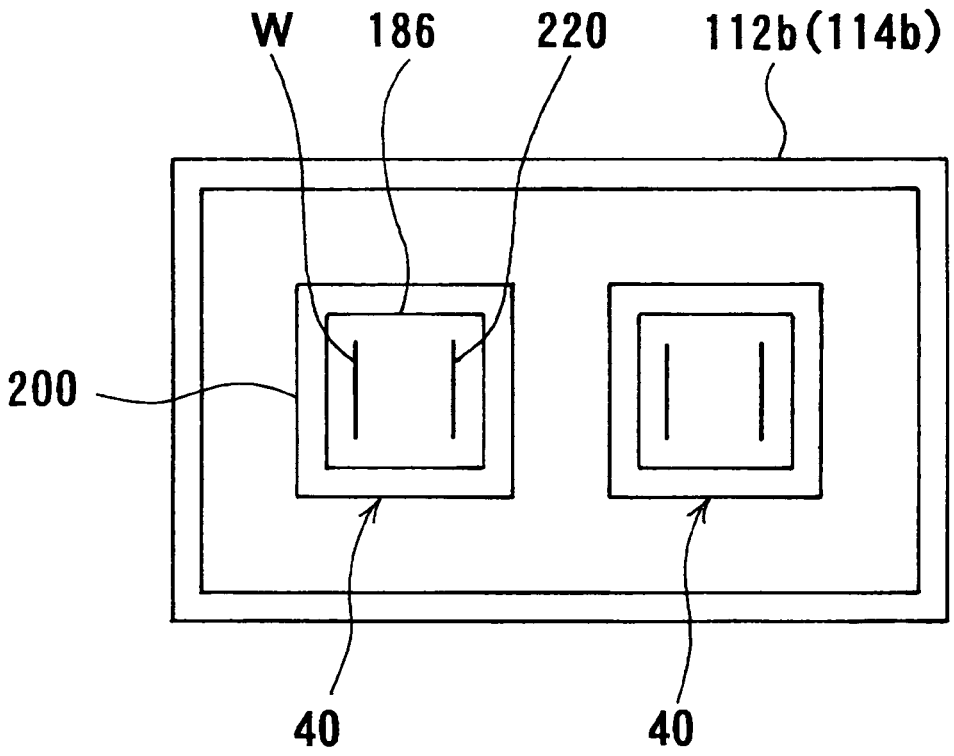
FIG. 15 is a plan view showing yet another example of a plating tank and magnetic field generator.

In this embodiment, the magnetic field generator 114 is comprised of the cylindrical electromagnet 112 surrounding the circumference of the plating tank 40. It is also possible to use a magnetic field generator 114*a*, as shown in FIG. 14, comprised of a rectangular electromagnet 112 surrounding the circumference of the plating tank 40. As shown in FIG. 15, it is also possible to arrange a plurality of plating tanks 40 (e.g., two tanks as shown), each including the plating tank body 186 and the overflow tank 200, in parallel and to surround the plurality of plating tanks 40 with a single magnetic field generator 114*b* comprised of a rectangular electromagnet 112*b*.

Figure 16:
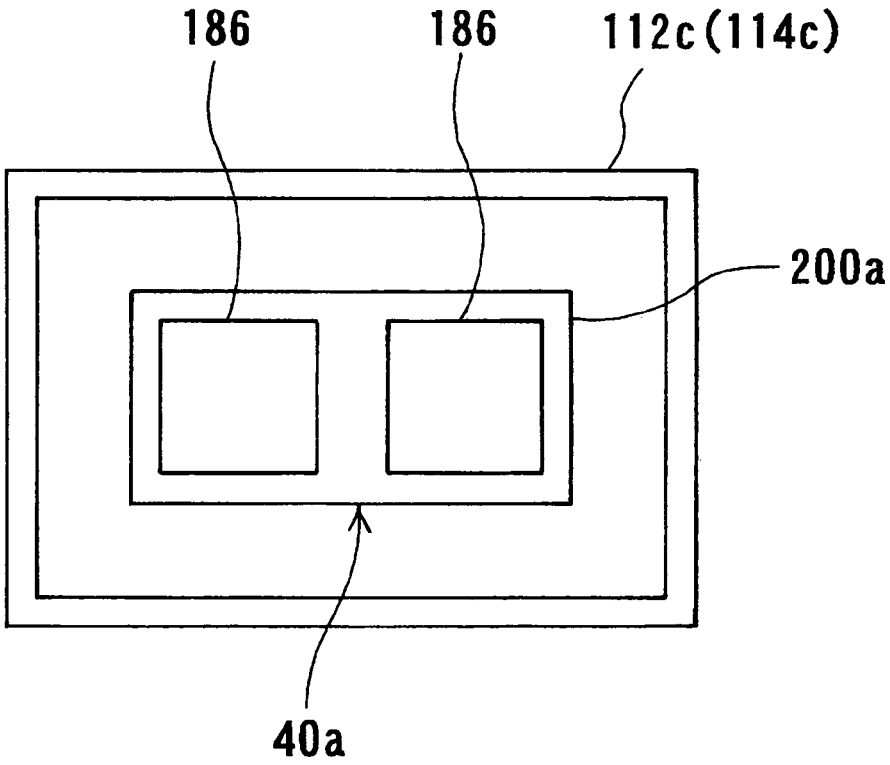
FIG. 16 is a plan view showing yet another example of a plating tank and magnetic field generator.

When a common plating solution is used, it is possible to use a plating tank 40*a* including a plurality of plating tank bodies 186 disposed inside one overflow tank 200*a*, as shown in FIG. 16, and to surround the circumference of the plating tank 40*a* with a magnetic field generator 114*c* comprised of an electromagnet 112*c*.

Though a magnetic field generator comprised of an electromagnet, which can adjust a magnetic force, e.g., in the range of 0 to 500 G (0 to 0.05 T), is used in the above embodiments, it is possible to use a magnetic field generator comprised of a permanent magnet. When a magnetic field generator comprised of a permanent magnet is used, the permanent magnet is disposed such that the N pole and the S pole line up vertically.

Figure 17:
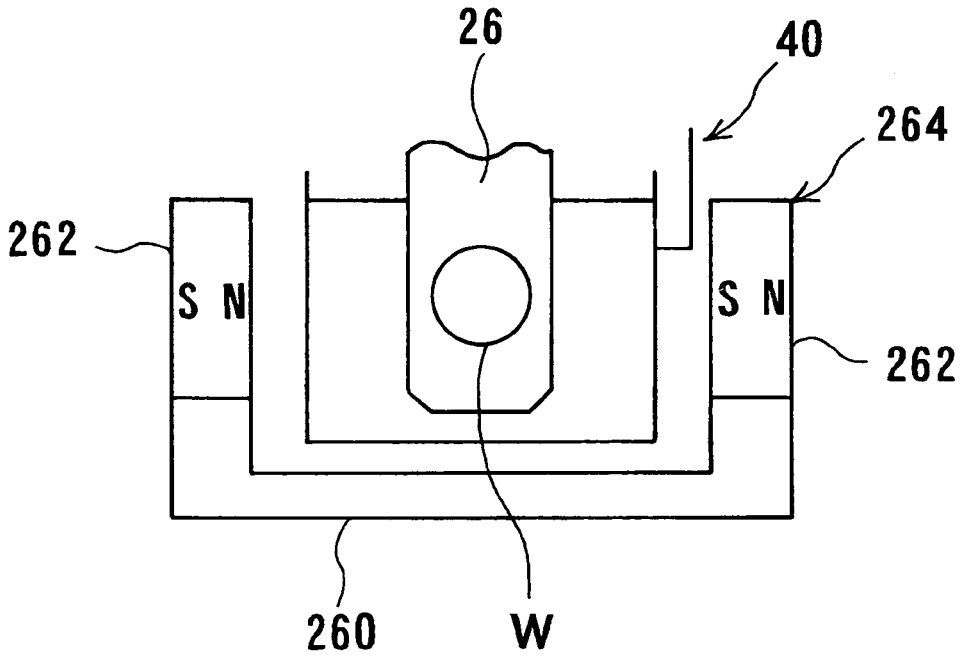
FIG. 17 is a diagram illustrating the positional relationship between a substrate holder, a plating tank and a magnetic field generator in a magnetic film plating apparatus according to another embodiment of the present invention.

FIG. 17 is a diagram illustrating the positional relationship between a substrate holder, a plating tank and a magnetic field generator in a magnetic film plating apparatus according to another embodiment of the present invention. In this embodiment is used a magnetic field generator 264 comprised of a pair of permanent magnets 262 mounted on a support 260 and disposed on opposite sides of a plating tank 40. The magnetic field generator 264 forms a magnetic field around and parallel to a substrate W held by the substrate holder 26 and immersed in a vertical position in a plating solution Q. The magnetic field generator 264 may be comprised of an electromagnet, as described above.

Figure 18:
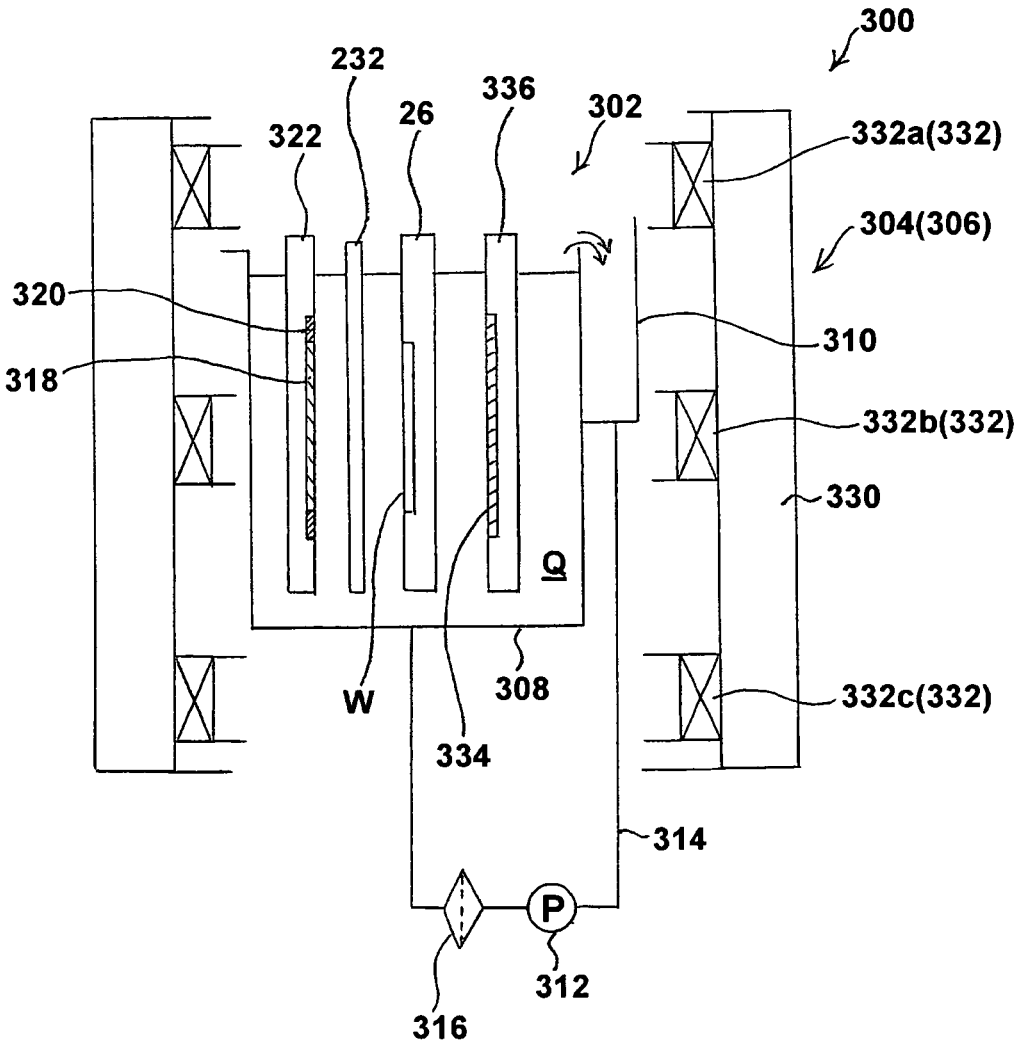
FIG. 18 is a schematic view of a magnetic film plating apparatus according to yet another embodiment of the present invention.
Figure 19:
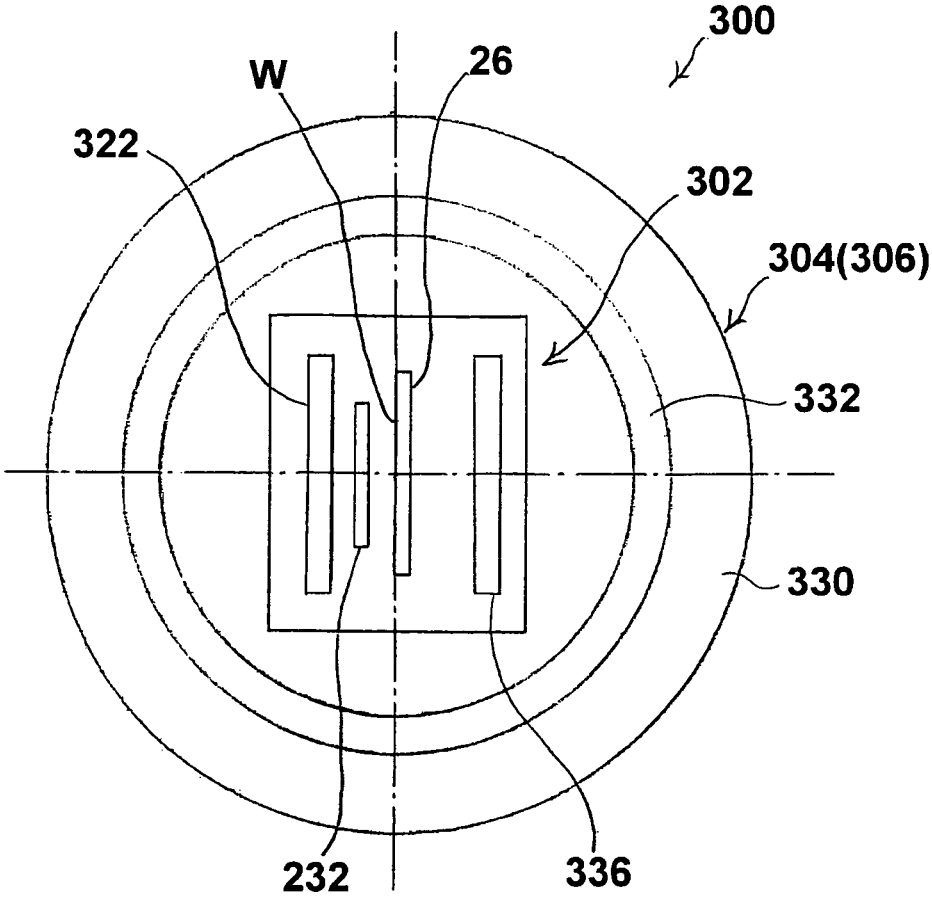
FIG. 19 is a plan view of FIG. 18.

FIGS. 18 and 19 schematically show a magnetic film plating apparatus according to yet another embodiment of the present invention. The magnetic film plating apparatus 300 mainly comprises a vertically-movable substrate holder 26, having the same construction as described above, for detachably holding and transporting a substrate W, a plating tank 302 and a magnetic field generator 306 comprised of a cylindrical electromagnet 304 disposed around the plating tank 302.

The plating tank 302 includes a plating tank body 308 for holding therein a certain amount of plating solution Q in which a substrate W, held by the substrate holder 26 with its peripheral portion watertightly sealed by the seal member 60 (see FIGS. 7A through 7C) and its front surface (surface to be plated) exposed, is to be immersed in a vertical position. An overflow tank 310 for receiving the plating solution Q that has overflowed the edge of the plating tank body 308 is provided around an upper portion of the plating tank body 308. One end of circulation piping 314, which is provided with a pump 312, is connected to the bottom of the overflow tank 310, and the other end of the circulation piping 314 is connected to the bottom of the plating tank body 308. Thus, the plating solution Q collected in the overflow tank 310 is returned into the plating tank body 308 by the actuation of the pump 312. Located downstream of the pump 312, a filter 316 for filtering out foreign matter contained in the plating solution is interposed in the circulation piping 314. In the plating tank 302 of this embodiment, the plating solution Q flows upwardly approximately parallel to the surface of the substrate W held by the substrate holder 26 and flows into the overflow tank 310. The circulation piping 314 may also be provided with a constant-temperature unit as in the above-described embodiment, and a degasifier for the plating solution.

A disk-shaped anode 318, conforming to the shape of the substrate W, and a first dummy anode 320 surrounding the circumference of the anode 318 are held by a first anode holder 322 and disposed in a vertical position in the plating tank body 308. When the plating solution Q is filled into the plating tank body 308, the anode 318 and the first dummy anode 320 become immersed in the plating solution Q and face the substrate W held by the substrate holder 26 and disposed at a predetermined position in the plating tank body 308. Nickel (Ni), which is a ferromagnetic material, is used for the anode 318. Instead of the nickel anode, it is also possible to use an insoluble anode (e.g., Ti coated with $IrO_2$ or Ti cladded with 1-μm Pt).

Figure 20A:
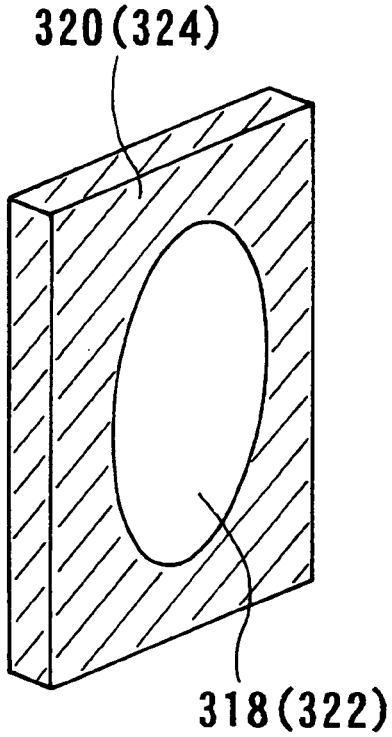
FIG. 20A is a perspective view showing an anode and a first dummy anode.
Figure 20B:
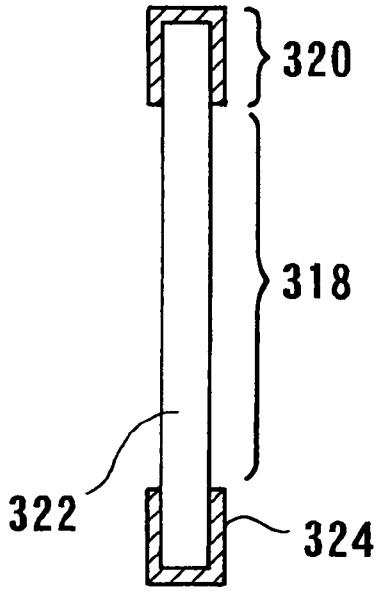
FIG. 20B is a vertical sectional front view showing the anode and the first dummy anode.
Figure 21:
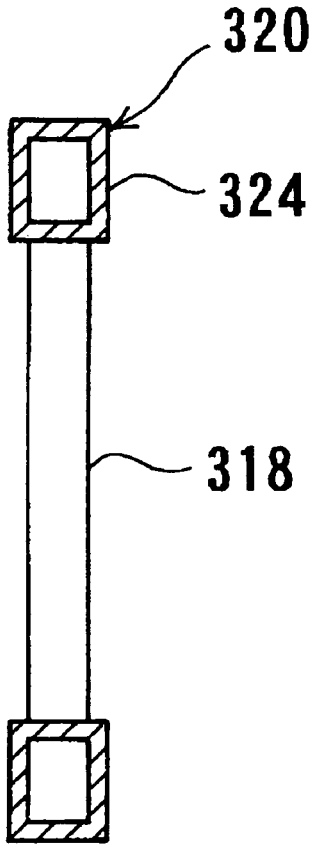
FIG. 21 is a vertical sectional front view showing another anode and first dummy anode.

FIGS. 20A and 20B show the anode 318 and the first dummy anode 320. As shown in FIGS. 20A and 20B, in this embodiment, a rectangular anode material 322, in its peripheral portion other than the central circular portion, is coated with a resin 324 to prevent deposition thereon from the plating solution; and the anode 318 is the portion not coated with the resin 324, while the first dummy electrode 320 is the portion coated with the resin 324. By thus constructing the anode 318 and the first dummy anode 320 integrally, formation of a gap between the anode 318 and the first dummy anode 320 can be prevented. As shown in FIG. 21, it is also possible construct the anode 318 and the first dummy anode 320, which is entirely coated with the resin 324, as separate members. This enables replacement of the first dummy anode 320.

In the plating tank body 308, between the anode 318 and the substrate W, held by the substrate holder 26 and disposed at a predetermined position in the plating tank body 308, is disposed a vertically-extending stirring paddle 232 having the same construction as described above, which reciprocates parallel to the substrate W to stir the plating solution Q between the substrate W and the anode 318. By stirring the plating solution Q between the substrate W and the anode 318 by the stirring paddle 232, ions in the plating solution Q can be supplied uniformly to the surface of the substrate W. As with the above-described embodiment, an electric field regulation plate may be disposed between the stirring paddle 232 and the anode 318.

The magnetic field generator 306 comprised of the electromagnet 304 is disposed outside the plating tank 302. The electromagnet 304 comprises a cylindrical yoke 330 and a coil 332 extending circumferentially on the inner circumferential surface of the yoke 330. The magnetic field generator 306 can form a vertical magnetic field parallel to and in the vicinity of the substrate Win the plating tank 302, enabling the formation of a magnetic film, having magnetic anisotropy, on the substrate surface by electroplating. In this embodiment, the coil 332 is divided into an upper coil 332*a*, a middle coil 332*b* and a lower coil 332*c*. Bypassing independent electric currents through the respective coils 332*a*, 332*b* and 332*c*, vertical magnetic fields of different strengths can be formed around vertically upper, middle and lower portions of the substrate W.

In this embodiment, a desired magnetic field can be formed by controlling respective electric currents applied to the coils 332*a*, 332*b* and 332*c*. For example, the magnetic field can be adjusted by, for example, changing the current applied to the middle coil 332*b* while keeping the currents applied to the upper coil 332*a* and the lower coil 332*c* constant. Though the three coils are used in this embodiment, any number of coils may be selected depending on the intended magnetic field, the size of the substrate, etc.

By disposing the coil 332 inside the yoke 330, leakage of magnetic field to the outside of the plating tank 302 can be suppressed. This enables a plurality of plating tanks 40 to be installed in adjacent positions. By making the vertical size of the electromagnet 304 used as the magnetic field generator 306 sufficiently larger than the size of the plating tank 302 and the size of the substrate W, a stable magnetic field can be formed around the substrate W in the plating tank 302. As with the above-described embodiment, the electromagnet 332 comprised of the yoke 330 and the coil 332 is coated with a resin (not shown) resistant to a plating solution so that the electromagnet 304 will not be damaged if the plating solution splatters and adheres to the electromagnet 304.

As shown in FIG. 19, the substrate W held by the substrate holder 26 is disposed at the center of the electromagnet 304, and the anode 318 is disposed opposite the surface (surface to be plated) of the substrate W. There is a slight possibility of deviation of magnetic field lines from a reference direction at a position spaced apart from the center of the electromagnet 304. In addition, the magnetic field is basically formed symmetrically with respect to the center of the electromagnet 304. Accordingly, disposing the substrate W at the center of the electromagnet 304 is most advantageous to the formation of a uniform magnetic field parallel to the surface of the substrate W.

In this embodiment, a second dummy electrode 336, having the same size as or similar size to the size of the sum of the anode 318 and the first dummy anode 320, held by a second anode holder 336, is disposed on the opposite side of the substrate W from the anode 318 and at the same distance from the substrate W as the distance of the anode 318 from the substrate W. Similarly to the above-described first dummy electrode 320, the second dummy anode 336 comprises an anode material, for example nickel, which is entirely coated with a resin to prevent deposition thereon from a plating solution.

In this embodiment, in order to form a vertical magnetic field parallel to the substrate W, the first dummy anode 318 and the second dummy anode 334 are disposed parallel to the substrate W and the anode 318. If they are not parallel to each other, the direction of the magnetic field is unlikely to be uniform in the substrate surface.

When a ferromagnetic material is used for the anode 318 and only the anode 318 is installed opposite the substrate W, magnetic field lines in the surface of the substrate W are attracted toward the anode 318. Accordingly, the magnetic flux density in the surface of the substrate W decreases and variation in the magnetic flux density in the substrate surface becomes larger, resulting in increased deviation of the direction of the magnetic field lines from the reference direction (vertical direction). By disposing the substrate W at the center of the electromagnet 304 and between the anode 318 and the second dummy anode 334, inclination of the magnetic field lines from the vertical direction toward the normal direction of the substrate W can be reduced.

A region, in which magnetic field lines are curved, can be shifted away from the substrate W and the direction of magnetic field lines in the vicinity of the substrate W can be made closer to the reference direction by using the first dummy anode 320 having a larger size. The first dummy anode 320 is at a right angle to the reference direction of the magnetic flux. Accordingly, the use of the first dummy anode 320 in a rectangular shape, as compared to a circular shape, can make magnetic field lines in the vicinity of the substrate closer to the reference direction.

For example, when a substrate W having a diameter of 300 mm is used, an anode 318 whose diameter is somewhat smaller than 300 mm is used. The circumference of the anode 318 is surrounded by a square first dummy anode 320 whose each side has a length of, e.g., 390 mm. On the opposite side of the substrate from the first dummy anode 320 is installed a second dummy anode 334, having the same square shape as the first dummy anode 320, such that the distance between it and the substrate is equal to the distance between the anode 318/the first dummy anode 320 and the substrate. The dummy anodes 320, 334 may not be of a square shape. The thicknesses of the anode 318 and the dummy anodes 320, 334 are equal. The smaller their thickness is, the lower is their effect of attracting magnetic field lines. Therefore, their aspect ratio (diameter or length of each side/thickness) is preferably not less than 45.

Though the anode 318 surrounded by the first dummy anode 320 and the second dummy anode 336 are disposed opposite each other with the substrate W interposed therebetween in this embodiment, it is also possible to dispose only the anode 318, surrounded by the first dummy anode 320, opposite the substrate W without providing the second dummy anode 336. This can also reduce deviation of the magnetic flux in the substrate surface from the reference direction.

Figure 22A:
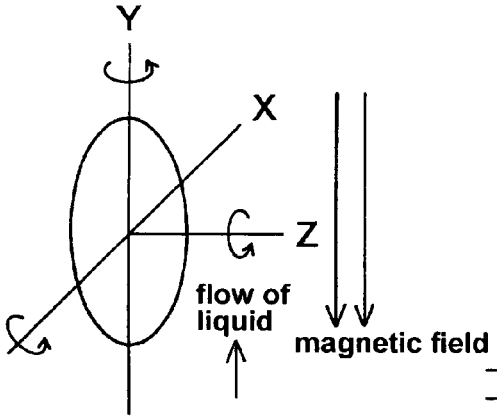
FIGS. 22A through 22C are diagrams illustrating various relationships between the direction of a substrate, the direction of a magnetic field and the direction of the flow of plating solution.
Figure 22C:
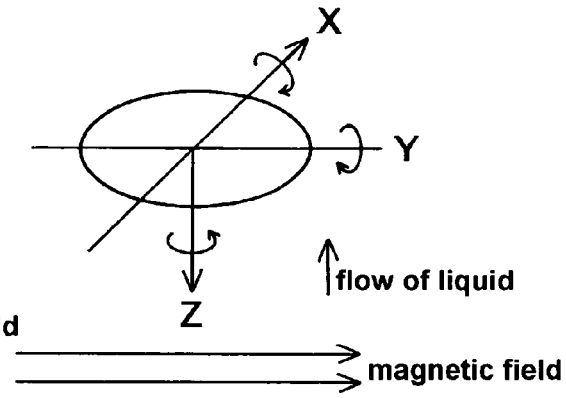
Figure 22B:
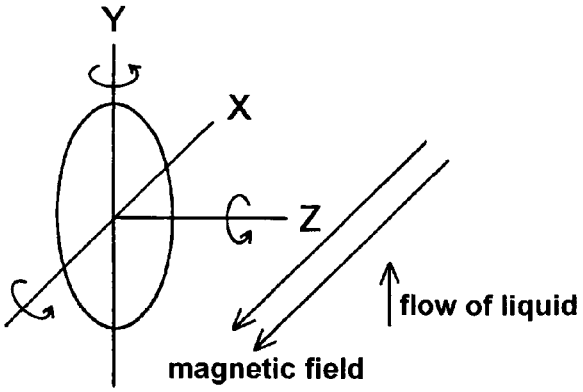

When designing the direction of a substrate, the direction of a magnetic field and the direction of the flow of a plating solution in a plating apparatus that generates a magnetic field parallel to a substrate, the following three methods, as shown in FIGS. 22A through 22C, may be considered: a method in which a substrate is held vertically, a magnetic field is formed in a vertical direction and a plating solution is allowed to flow upwardly, as shown in FIG. 22A (hereinafter referred to as "method A"); a method in which a substrate is held vertically, a magnetic field is formed horizontally and a plating solution is allowed to flow upwardly, as shown in FIG. 22B (hereinafter referred to as "method B"); and a method in which a substrate is held horizontally (with its surface to be plated facing downwardly), a magnetic field is formed horizontally and a plating solution is allowed to flow upwardly, as shown in FIG. 22C (hereinafter referred to as "method C"). The magnetic film plating apparatus 110 shown in FIG. 8 and the magnetic film plating apparatus 300 shown in FIGS. 18 and 19 employ the method A. A so-called cup method in which a substrate is brought into contact with a plating solution, which is caused to flow upwardly, is considered to correspond to the method C.

The degree of freedom of the direction of a substrate will now be compared between the three methods. If the angle of a substrate around the X-axis deviates in the A method, the substrate will become non-parallel to the magnetic field. If the angle of the substrate around the Z-axis deviates, the direction of a structure formed on the substrate will deviate with respect to the direction of the magnetic field. On the other hand, even when the angle of the substrate around the Y-axis deviates to some degree, the magnetic field remains parallel to the flow of the plating solution. In view of the fact that it basically suffices if the substrate keeps parallel to an anode, it can be said that the direction of the substrate around the Y-axis has some degree of freedom. With reference to the method B, the direction of a substrate around the Y-axis and the direction around the Z-axis need to be set precisely for the same reasons. The substrate remains parallel to a magnetic field if the angle of the substrate around the X-axis deviates. The substrate, however, becomes non-parallel to the flow of plating solution, which can affect the in-plane uniformity of a plated film. With reference to the method C, the direction of a substrate around the X-axis and the direction around the Z-axis need to be set precisely for the above reasons. If the angle of the substrate around the Y-axis deviates, a plating solution will not hit the substrate uniformly, which may affect the in-plane uniformity of a plated film. In summary, the method B and the method C thus need three-axis adjustment, whereas the method A, which is employed by the magnetic film plating apparatus 110 shown in FIG. 8 as well as the magnetic film plating apparatus 300 shown in FIGS. 18 and 19, only needs adjustment of the two axes and thus has a higher degree of freedom. This is a great advantage for a mechanism which transports a substrate, held by a substrate holder, in an apparatus.

As shown in FIG. 18, in this embodiment, three coils, the upper coil 332*a*, the middle coil 332*b* and the lower coil 332*c*, are disposed in the height direction of the yoke 330. The vertical position of the middle coil 332*b* is preferably equal to the vertical setting position of the substrate W. It is desirable that the upper coil 332*a* and the lower coil 332*c* be disposed at the same distance from the middle coil 332*b*. Further, it is desirable that the center position of the yoke 330 in the height direction be equal to the vertical setting position of the substrate W.

While the strength of a magnetic field cannot be adjusted when a permanent magnet is used as a magnetic field generator, the use of the electromagnet 304 can easily control the strength of a magnetic field. In this embodiment, the magnetic force can be controlled, e.g., in the range of 0 to 500 G (0 to 0.05 T). If necessary, the electromagnet 304 may be provided with a cooling mechanism.

Figure 23:
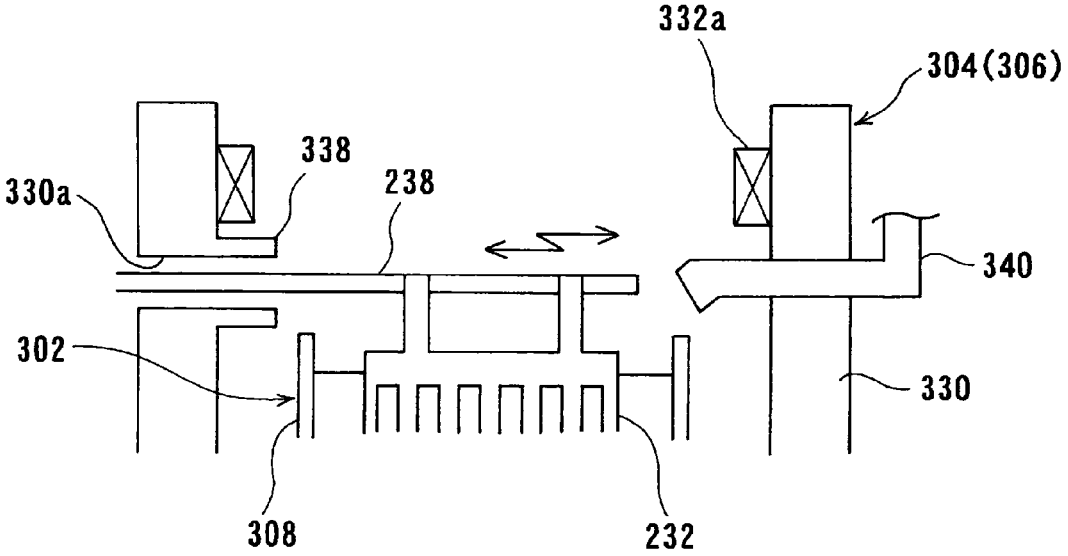
FIG. 23 is an enlarged view of the main portion of FIG. 18.

In this embodiment, as shown in FIG. 23, a paddle shaft insertion hole 330*a* for insertion of the paddle shaft 238 (see FIG. 12) into the yoke 338 is provided at a position slightly below the upper coil 332*a* provided on an upper portion of the yoke 330 so that the paddle drive section 242 and the motor 244 (see FIG. 12) are positioned outside the yoke 330. Such construction can suppress the influence of the magnetic field formed by the electromagnet 304 on the motor 244 or on a transport device for use in transport of, e.g., a substrate holder. Further in this embodiment, a cylindrical portion 338 is provided at the inner opening end of the paddle shaft insertion hole 330*a* in order to minimize leakage of magnetic field to the exterior.

In this embodiment, a plurality of exhaust ducts 340, each penetrating an upper portion of the yoke 330 at a position slightly below the upper coil 332*a* and reaching an upper position in the plating tank 302, are provided. By creating flows of air flowing from the plating tank 302 toward the exhaust ducts 340, and discharging a vapor evaporating from the plating solution with the flows of air to the outside of the yoke 330, contamination of a substrate with the vapor can be prevented. An arbitrary number of exhaust ducts may be provided. The air inlets of the exhaust ducts 340 are provided at upper positions in the plating tank 302 at which the inlets do not interfere with movements of the substrate holder 26, the stirring paddle 232 (see FIG. 12), etc. Though the exhaust ducts 340, penetrating the yoke 330, are provided at positions slightly below the upper coil 332*a* in this embodiment, exhaust ducts, penetrating the yoke 330 and communicating with the outside, may be provided at any positions, e.g., between the middle coil 332*b* and the lower coil 332*c*.

In operation of the magnetic film plating apparatus shown in FIGS. 18 and 19, similarly to the above-described magnetic film plating apparatus shown in FIG. 8, a predetermined amount of plating solution Q having a predetermined composition is first filled into the plating tank body 308 and allowed to circulate. The substrate holder 26 holding a substrate W is lowered to dispose the substrate W at a predetermined position in the plating tank body 308 where the substrate W is immersed in the plating solution Q and held vertically. The anode of a plating power source is connected to the anode 318 and the dummy anodes 320, 334 and the cathode is connected to the substrate W and, at the same time, electric current is passed through the upper coil 332*a*, the middle coil 332*b* and the lower coil 332*c* of the electromagnet 302 independently, thereby forming an upwardly directed magnetic field around and approximately parallel to the substrate W held by the substrate holder 26. A plated film, a magnetic film (permalloy) having magnetic anisotropy, is allowed to grow on the surface of the substrate W while stirring the plating solution Q between the anode 318 and the substrate W by the stirring paddle 232, as necessary, by moving the stirring paddle 232 parallel to the substrate W. After a predetermined time has elapsed from the start of plating, the anode 318, the dummy anodes 320, 334 and the substrate W are disconnected from the plating power source, and the supply of electric current to the upper coil 332*a*, the middle coil 332*b* and the lower coil 332*c* of the electromagnet 302, and the reciprocation of the stirring paddle 232 are stopped, thereby terminating plating.

As described above, in the magnetic film plating apparatus shown in FIG. 8 and the magnetic film plating apparatus shown in FIGS. 18 and 19, the angle of a substrate around the vertical axis is not restricted by the magnetic field; the substrate may face any direction insofar as the normal line of the substrate is horizontal. The angle of the substrate around the vertical axis is not restricted by the direction of the magnetic field insofar as the substrate makes a predetermined angle with respect to a plating tank and a structure inside the plating tank, such as an anode. This implies moderate restriction on designing or assembling of a plating facility, including a transport mechanism for transporting a substrate between processing tanks.

While the present invention has been described with reference to the embodiments thereof, it will be understood by those skilled in the art that the present invention is not limited to the particular embodiments described above, but it is intended to cover modifications within the inventive concept.

What is claimed is:

1. A magnetic film plating apparatus comprising:

a plating tank for holding therein a plating solution;

an anode vertically disposed in the plating tank at a position to be immersed in the plating solution;

a substrate holder for holding a substrate and positioning the substrate opposite the anode; and a cylindrical magnetic field generator comprised of an electromagnet and disposed around the plating tank, wherein the electromagnet comprises a cylindrical yoke disposed around the plating tank and a coil extending circumferentially on an inner circumferential surface of the cylindrical yoke, and is configured to generate a vertically directed magnetic field around and parallel to the substrate held by the substrate holder and positioned opposite the anode, wherein a center of the cylindrical yoke is located at the same height of the substrate; and wherein the coil comprises an upper coil, a middle coil, and a lower coil which are disposed vertically and the cylindrical magnetic field generator is configured to pass independent electric currents to the upper coil, the middle coil, and the lower coil to generate vertical magnetic fields of different strengths, the vertical position of the middle coil being equal to the vertical position of the substrate.

2. The magnetic film plating apparatus according to claim 1, wherein a first dummy anode, having a larger size than the substrate and surrounding the circumference of the anode, is disposed on the circumference of the anode.

3. The magnetic film plating apparatus according to claim 2, wherein the first dummy anode has a rectangular shape.

4. The magnetic film plating apparatus according to claim 2, wherein a second dummy anode is disposed on a side of the substrate opposite to the side which the anode is disposed.

5. The magnetic film plating apparatus according to claim 4, wherein the second dummy anode has the same shape and size as that of the anode and the first dummy anode together.

6. The magnetic film plating apparatus according to claim 4, wherein the surface of the substrate held by the substrate holder, the anode, the first dummy anode and the second dummy anode are disposed parallel to each other in the plating tank.

7. The magnetic film plating apparatus according to claim 1, wherein the substrate held by the substrate holder is disposed at the center of a space in which the magnetic field is formed by the magnetic field generator.

8. The magnetic film plating apparatus according to claim 1, wherein a stirring paddle for stirring the plating solution in the plating tank is disposed in the plating tank.

9. The magnetic film plating apparatus according to claim 1, wherein an electric field regulation plate for regulating the electric field in the plating tank is disposed in the plating tank.

10. The magnetic film plating apparatus according to claim 1, wherein a tray for preventing the plating solution from dropping downward is retractably provided under the substrate holder.

11. The magnetic film plating apparatus according to claim 1, wherein the plating tank is provided with an air bag for fixing the substrate holder in a predetermined position.

12. The magnetic film plating apparatus according to claim 1, wherein exhaust ducts are provided at positions along the side of the magnetic field generator.

13. The magnetic film plating apparatus according to claim 1, wherein the substrate holder is provided with a notch pin which, when the substrate is held by the substrate holder, enters a notch portion of the substrate to align the direction of the substrate with respect to the substrate holder.

14. A plating facility comprising:

the magnetic film plating apparatus according to claim 1;

an aligner for aligning the direction of a substrate; and a main frame in which the magnetic film plating apparatus and the aligner are housed.

15. The plating facility according to claim 14, wherein the plating tank of the magnetic film plating apparatus is provided in a plural number in the main frame.

16. The plating facility according to claim 14, wherein one or more of a pre-wetting tank, a pre-soaking tank, a blow tank and a rinsing tank are housed in the main frame.

17. The plating facility according to claim 16 further comprising a substrate holder transport apparatus for transporting the substrate holder of the magnetic film plating apparatus, wherein the substrate held by the substrate holder is transported between the tanks.

18. The magnetic film plating apparatus according to claim 1, wherein the anode is made of a ferromagnetic material.

19. The magnetic film plating apparatus according to claim 1, wherein the anode is an insoluble anode.

20. The magnetic film plating apparatus according to claim 1, wherein the upper coil and the lower coil are disposed at the same distance from the middle coil.

* * * * *